US011249428B2

(12) United States Patent
Makino

(10) Patent No.: US 11,249,428 B2
(45) Date of Patent: Feb. 15, 2022

(54) IMAGE FORMING APPARATUS

(71) Applicant: CANON KABUSHIKI KAISHA, Tokyo (JP)

(72) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/658,403

(22) Filed: Oct. 21, 2019

(65) Prior Publication Data

US 2020/0133183 A1 Apr. 30, 2020

(30) Foreign Application Priority Data

Oct. 24, 2018 (JP) ..... JP2018-200391

(51) Int. Cl.
*G03G 21/00* (2006.01)
*G03G 15/00* (2006.01)

(52) U.S. Cl.
CPC ..... *G03G 15/5016* (2013.01)

(58) Field of Classification Search
CPC ..... G03G 15/5016
See application file for complete search history.

(56) References Cited

U.S. PATENT DOCUMENTS 7,684,726 B2 3/2010 Suzuki et al.
9,715,354 B2 * 7/2017 Tachibana ..... G06F 3/121
2019/0129346 A1 * 5/2019 Okubo ..... G03G 15/6561

FOREIGN PATENT DOCUMENTS

JP 2018-020497 A 2/2018

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image forming apparatus includes an image forming portion capable of forming a toner image on an envelope including a flap; a stacking portion configured to stack the envelope; a fixing portion configured to fix the toner image on the envelope; a display portion configured to display information; an acquiring portion configured to acquire information corresponding to a kind of the envelope; and a controller configured to control the display portion when a double-side mode is selected, so that a stacking method in which the envelope is stacked on the stacking portion in a state in which an orientation of the envelope is designated on the basis of the information acquired by the acquiring portion is displayed at the display portion.

18 Claims, 21 Drawing Sheets

(a) ONE-SIDE PRINTING (b) DOUBLE-SIDE PRINTING

DOUBLE-SIDE PRINTING

DOUBLE-SIDE PRINTING

DOUBLE-SIDE PRINTING (a) ONE-SIDE/DOUBLE-SIDE : CREASE SUPPESS (OFF)

(b) DOUBLE-SIDE : CREASE SUPPESS (ON)

(a) ONE-SIDE PRINTING (b) DOUBLE-SIDE PRINTING

DOUBLE-SIDE PRINTING

ONE-SIDE PRINTING

ONE-SIDE PRINTING

DOUBLE-SIDE PRINTING

IMAGE FORMING APPARATUS

FIELD OF THE INVENTION AND RELATED ART

The present invention relates to an image forming apparatus, such as a printer, a copying machine, a facsimile machine or a multi-function machine using an electrophotographic type.

In recent years, the image forming apparatus is used for printing an image on an envelope in addition to sheets such as plain paper, thick paper, rough paper, embossed paper and coated paper. As such an image forming apparatus, an image forming apparatus in which a set direction (portrait, landscape) referred to by a user when stacks an envelope on a cassette or a manual feeding tray is displayed at a display portion provided on the image forming apparatus has been proposed (Japanese Laid-Open Patent Application 2018-20497).

Incidentally, as the image forming apparatus, there is an image forming apparatus in which a feeding mechanism for feeding the envelope again after front and back of the envelope is automatically reversed is provided and in which double-side printing that the front and back of the envelope is automatically reversed after a toner image is fixed on a first side and then a toner image is formed on a second side subsequently to the first surface is capable of being carried out. However, although the envelope is different from a general-purpose sheet and is formed in a bag shape with two sheets (papers) on front and back sides, conventionally, during double-side printing, display of an envelope stacking method for the double-side printing at a display portion has not been taken into consideration. Therefore, in order to improve ease-of-use of a user (usability), an image forming apparatus such that the envelope stacking method for the double-side printing is displayed at the display portion has been desired, but such an image forming apparatus has not yet been proposed.

SUMMARY OF THE INVENTION

A principal object of the present invention is to provide an image forming apparatus capable of improving a quality of an envelope in a constitution in which images are formed on the envelope by automatic double-side printing.

According to an aspect of the present invention, there is provided an image forming apparatus comprising: an image forming portion capable of forming a toner image on an envelope including a flap and capable of executing an operation in a one side mode in which an image is formed on one side of the envelope and an operation in a double side mode in which images are formed on both sides of the envelope; a stacking portion configured to stack the envelope fed to the image forming portion; a fixing portion configured to fix the toner image on the envelope, on which the toner image is formed by the image forming portion, by heating and pressing the envelope; a display portion configured to display information; an acquiring portion configured to acquire information corresponding to a kind of the envelope; and a controller configured to control the display portion when the double side mode is selected, so that a stacking method in which the envelope is stacked on the stacking portion in a state in which an orientation of the envelope is designated on the basis of the information acquired by the acquiring portion is displayed at the display portion.

Further features of the present invention will become apparent from the following description of exemplary embodiments with reference to the attached drawings.

Figure 9:
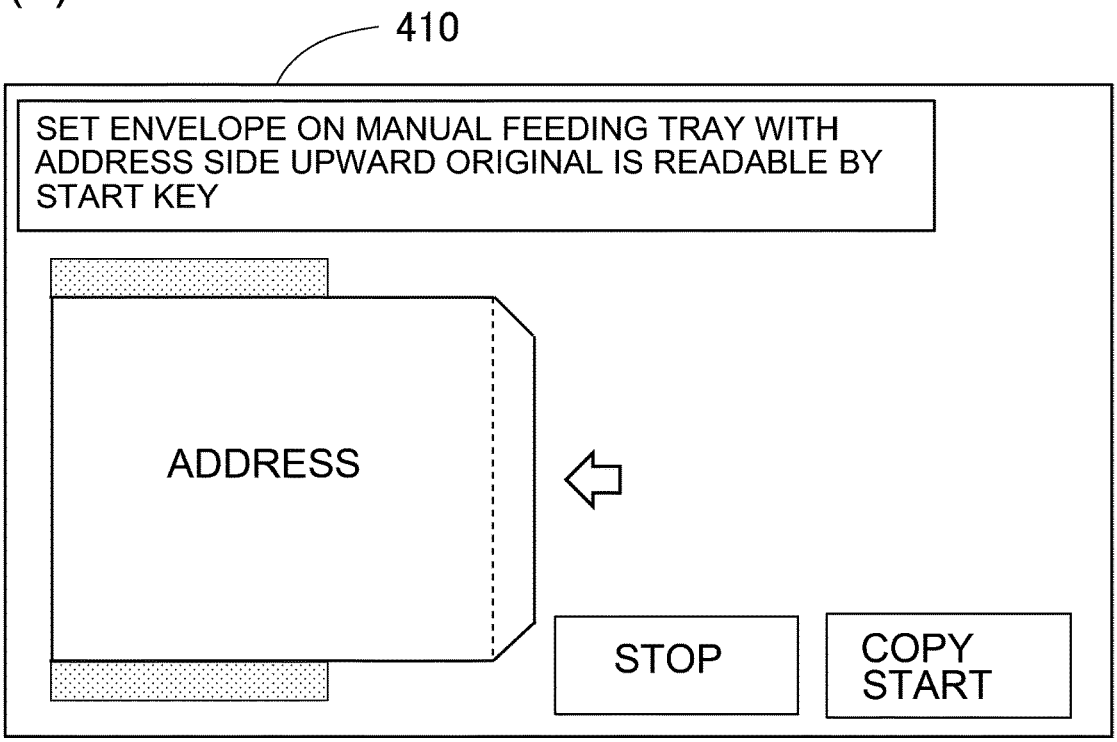
Figure 9:
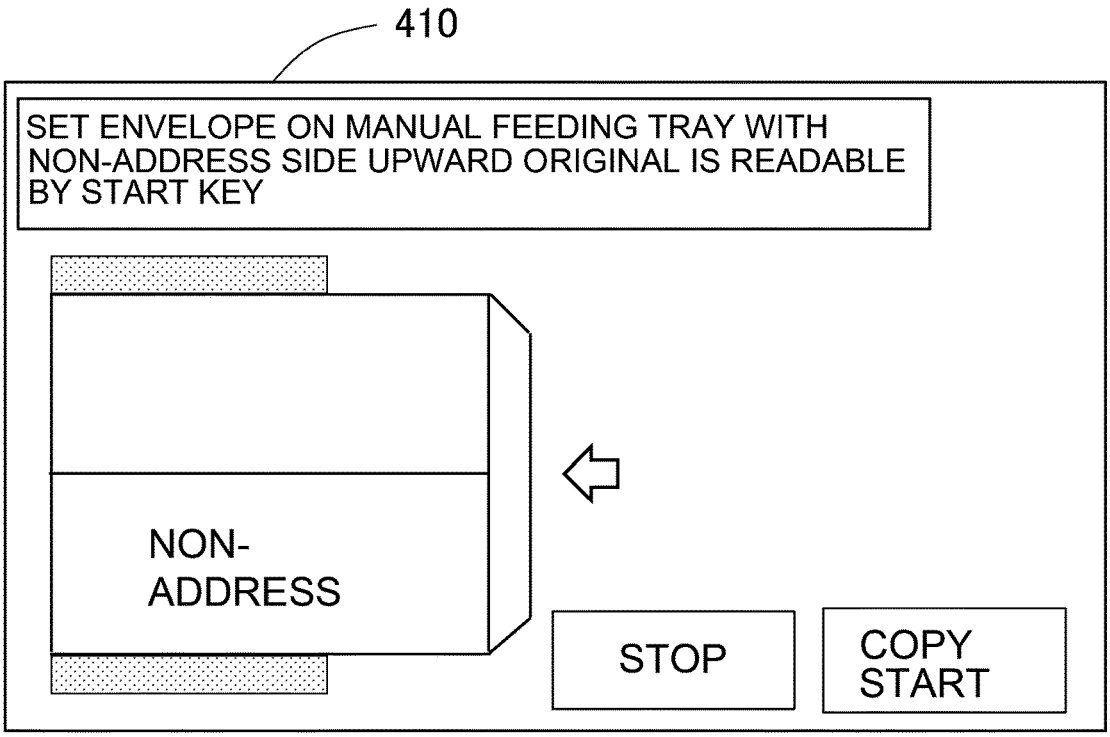

Parts (a) and (b) of FIG. 9 are schematic views each showing a display of an envelope in the case where the envelope is stacked on a manual feeding tray in the lateral feeding type, in which part (a) shows a display of the envelope during one-side printing, and part (b) shows the display of the envelope during double-side printing.

Figure 10:
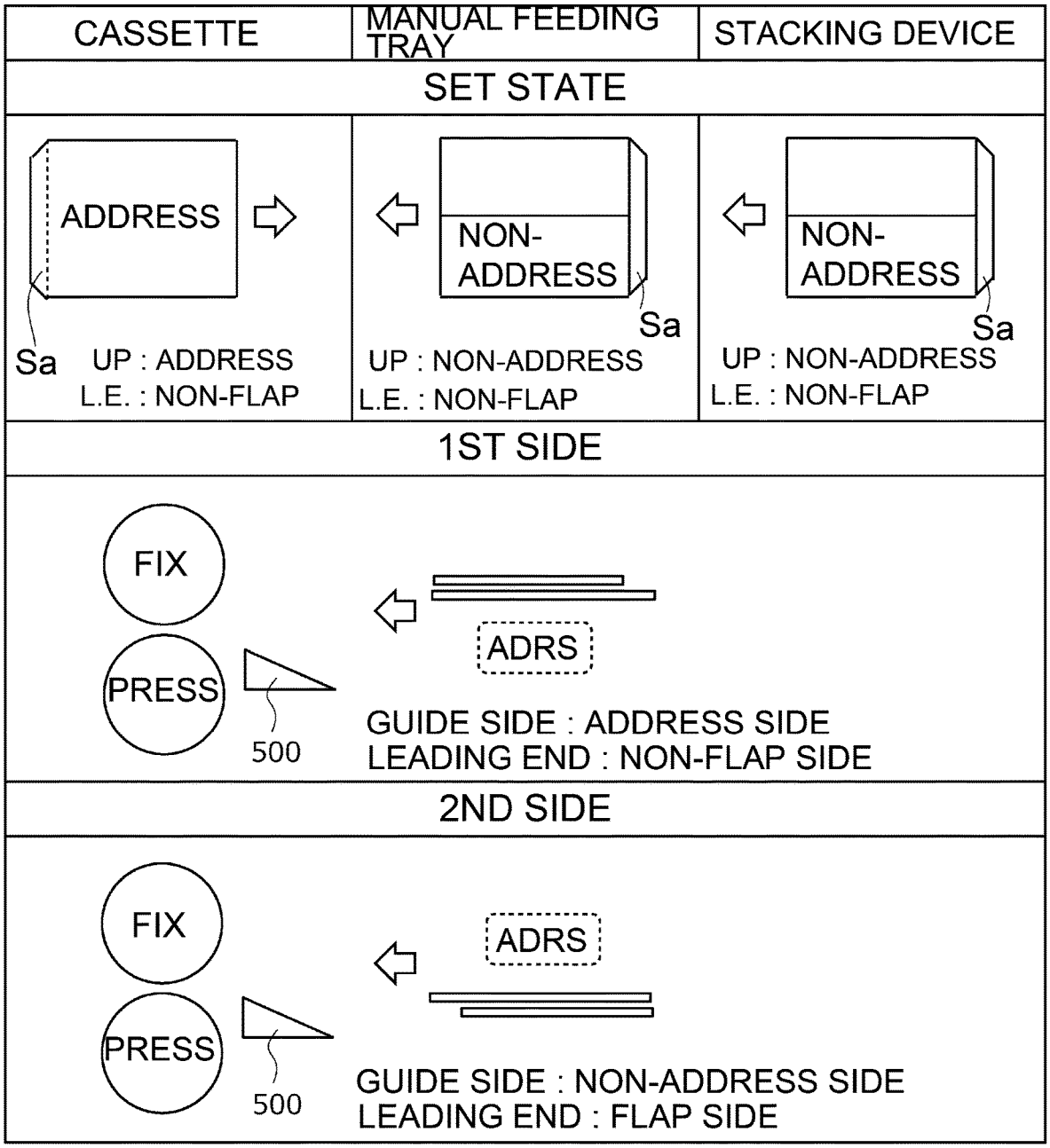

FIG. 10 is a schematic view showing a display example during double-side printing in the lateral feeding type.

Figure 11:
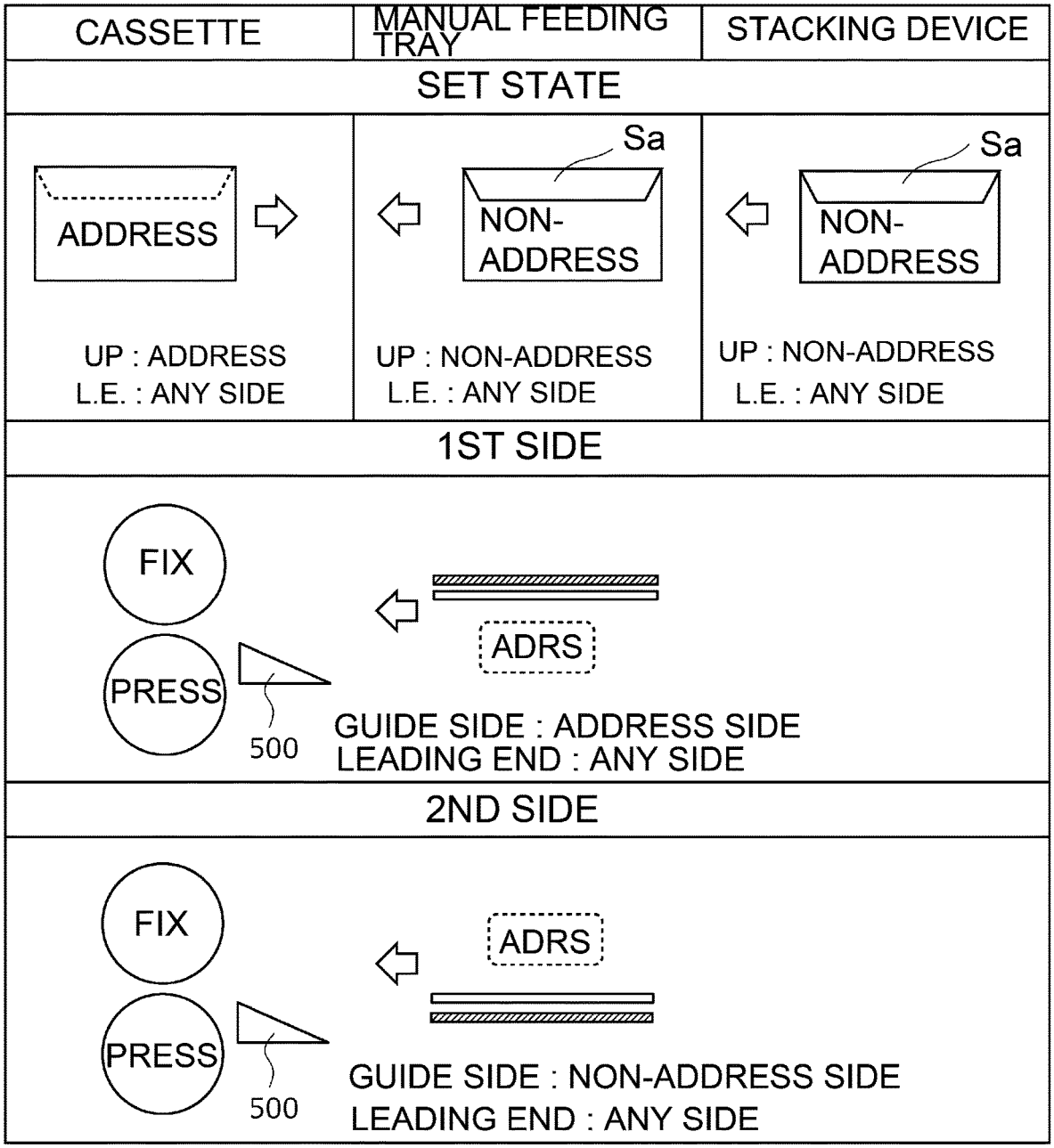

FIG. 11 is a schematic view showing another display example during double-side printing in the lateral feeding type.

Figure 12:
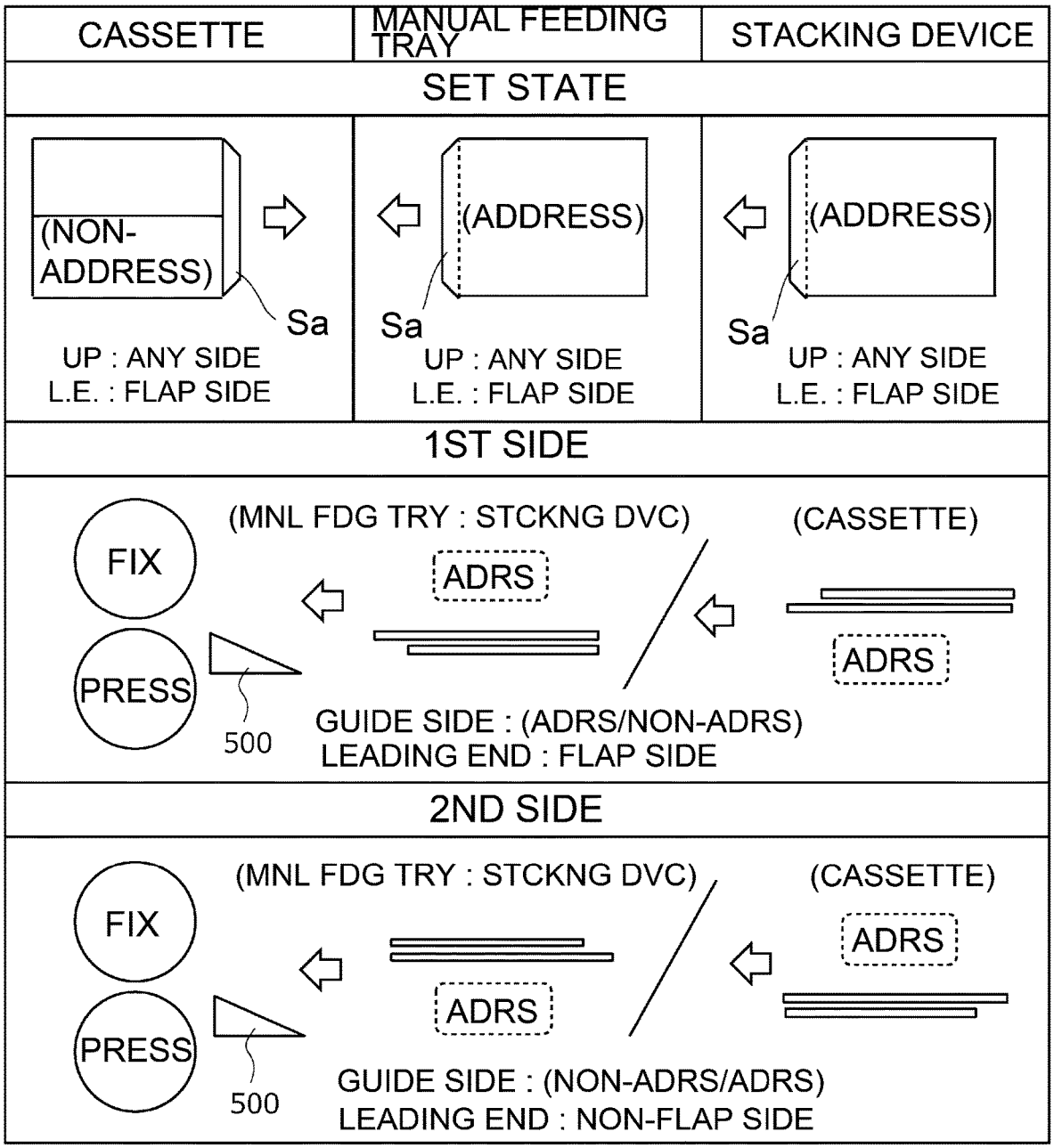

FIG. 12 is a schematic view showing a further display example during double-side printing in the lateral feeding type.

Figure 13:
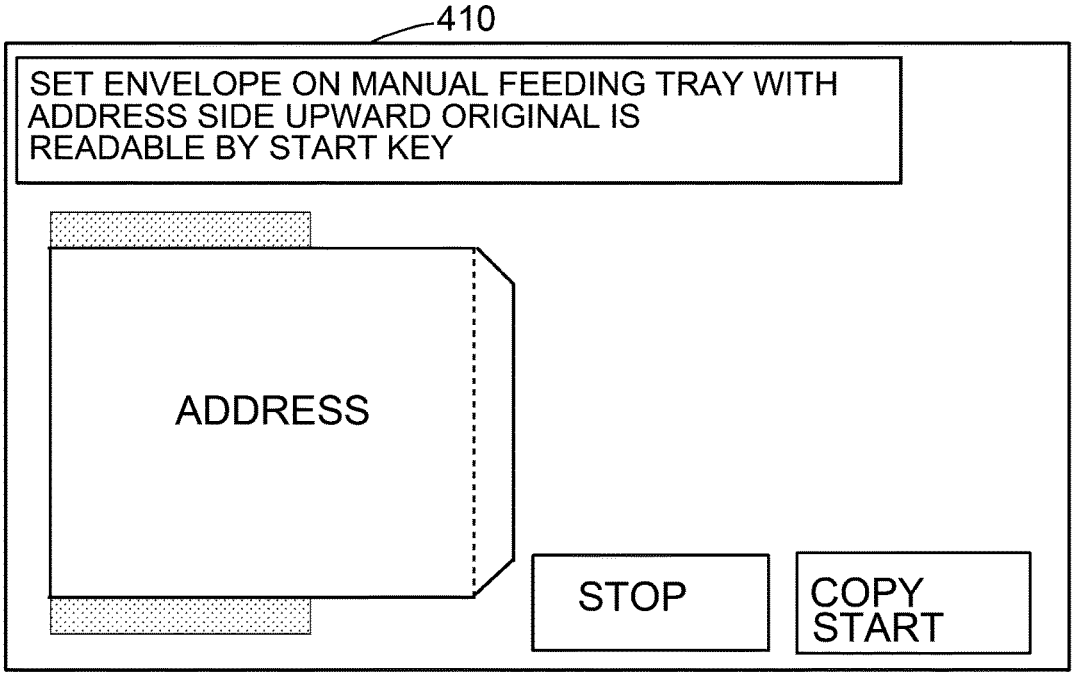
Figure 13:
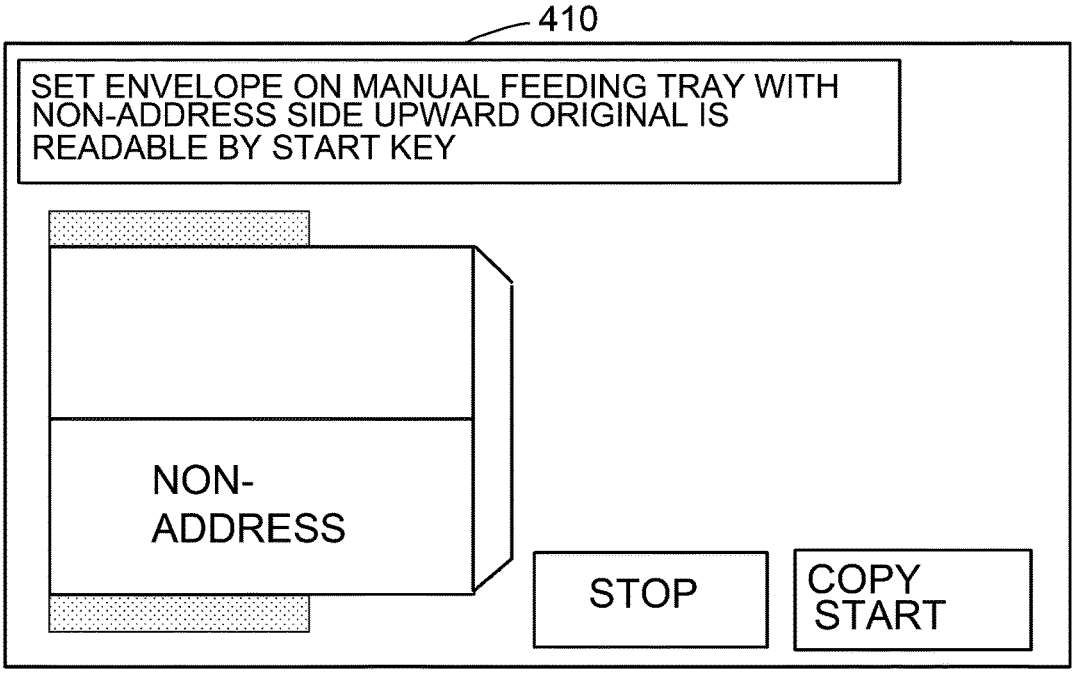

Parts (a) and (b) of FIG. 13 are schematic views each showing a display of an envelope in the case where the envelope is stacked on a manual feeding tray in the lateral feeding type, in which part (a) shows a state in which a crease suppressing mode is turned off, and part (b) shows a state in which the crease suppressing mode is turned on.

Figure 14:
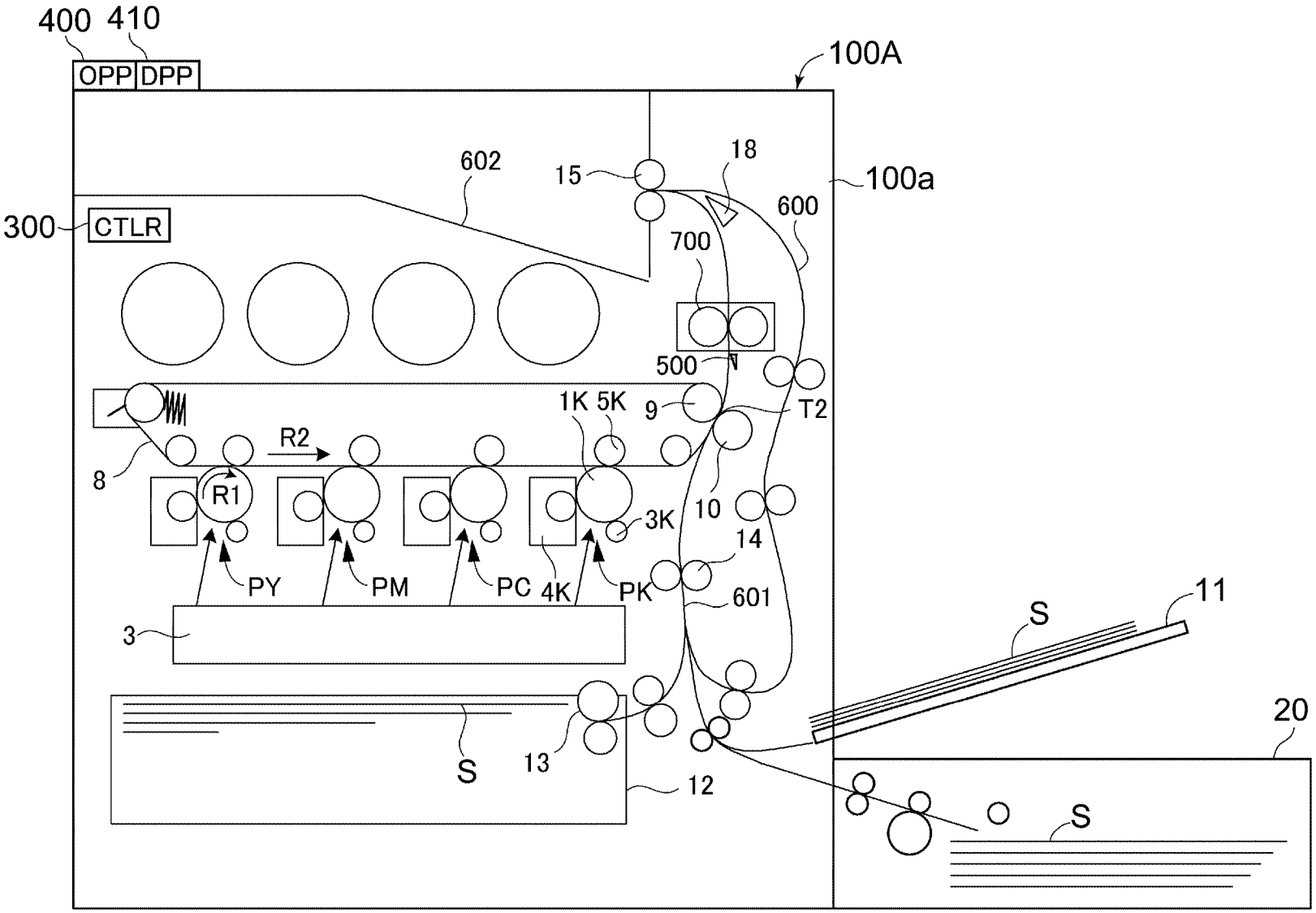

FIG. 14 is a schematic view showing an image forming apparatus of a vertical feeding type to which a control device in the embodiment is applicable.

Figure 15:
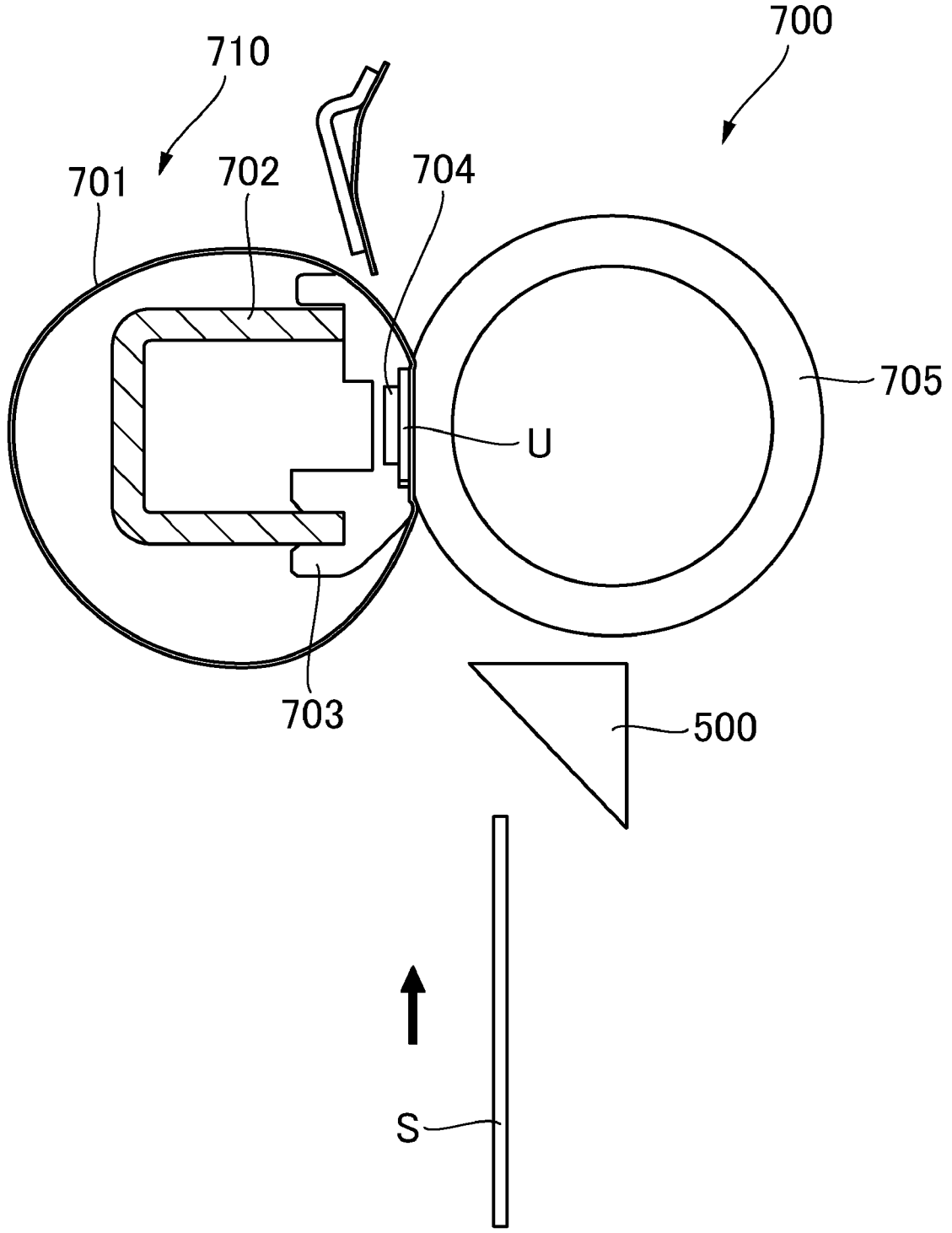

FIG. 15 is a schematic view showing another example of a fixing device.

Figure 16:
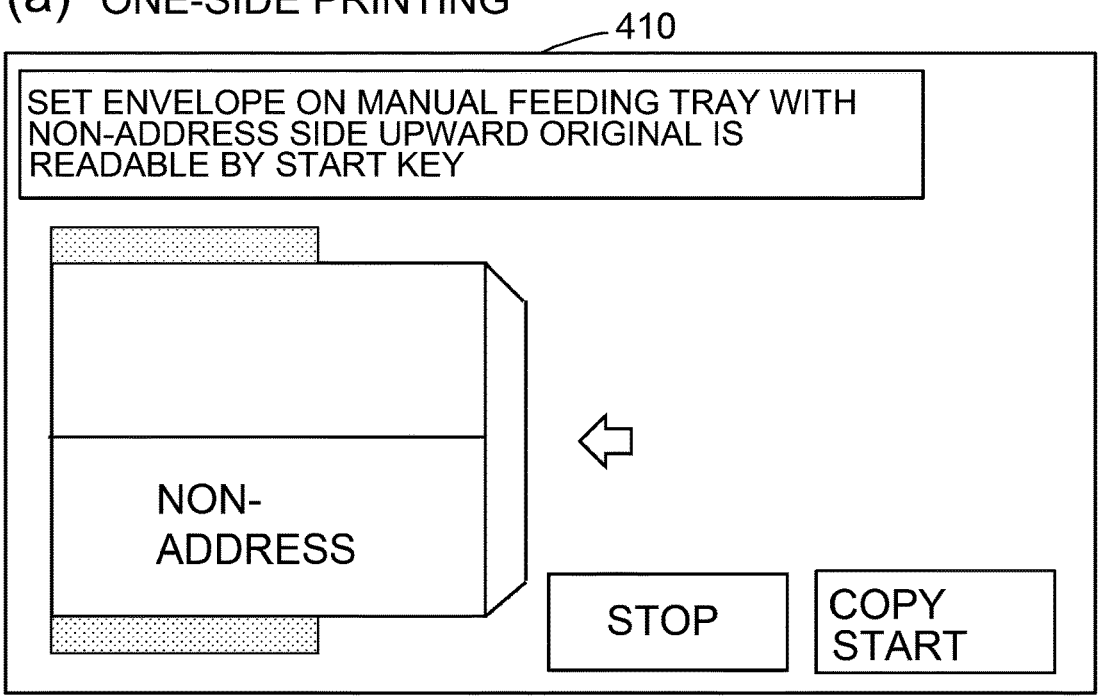
Figure 16:
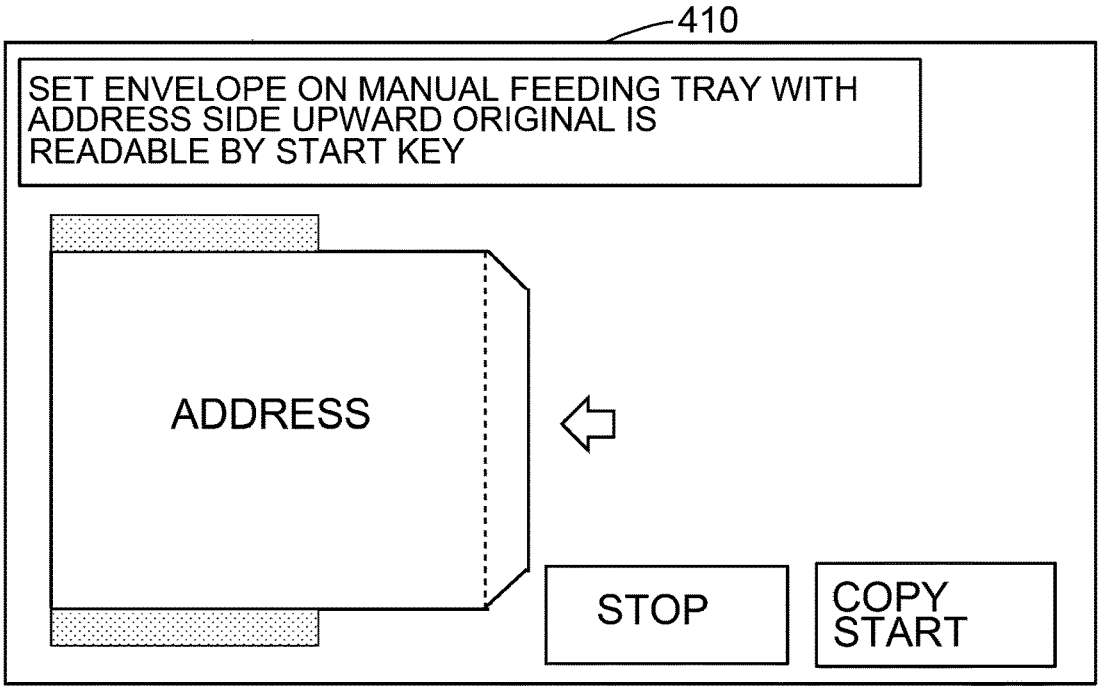

Parts (a) and (b) of FIG. 16 are schematic views each showing display of an envelope in the case where the envelope is stacked on a manual feeding tray in the vertical feeding type, in which part (a) shows the display of the envelope during one-side printing, and part (b) shows the display of the envelope during double-side printing.

Figure 17:
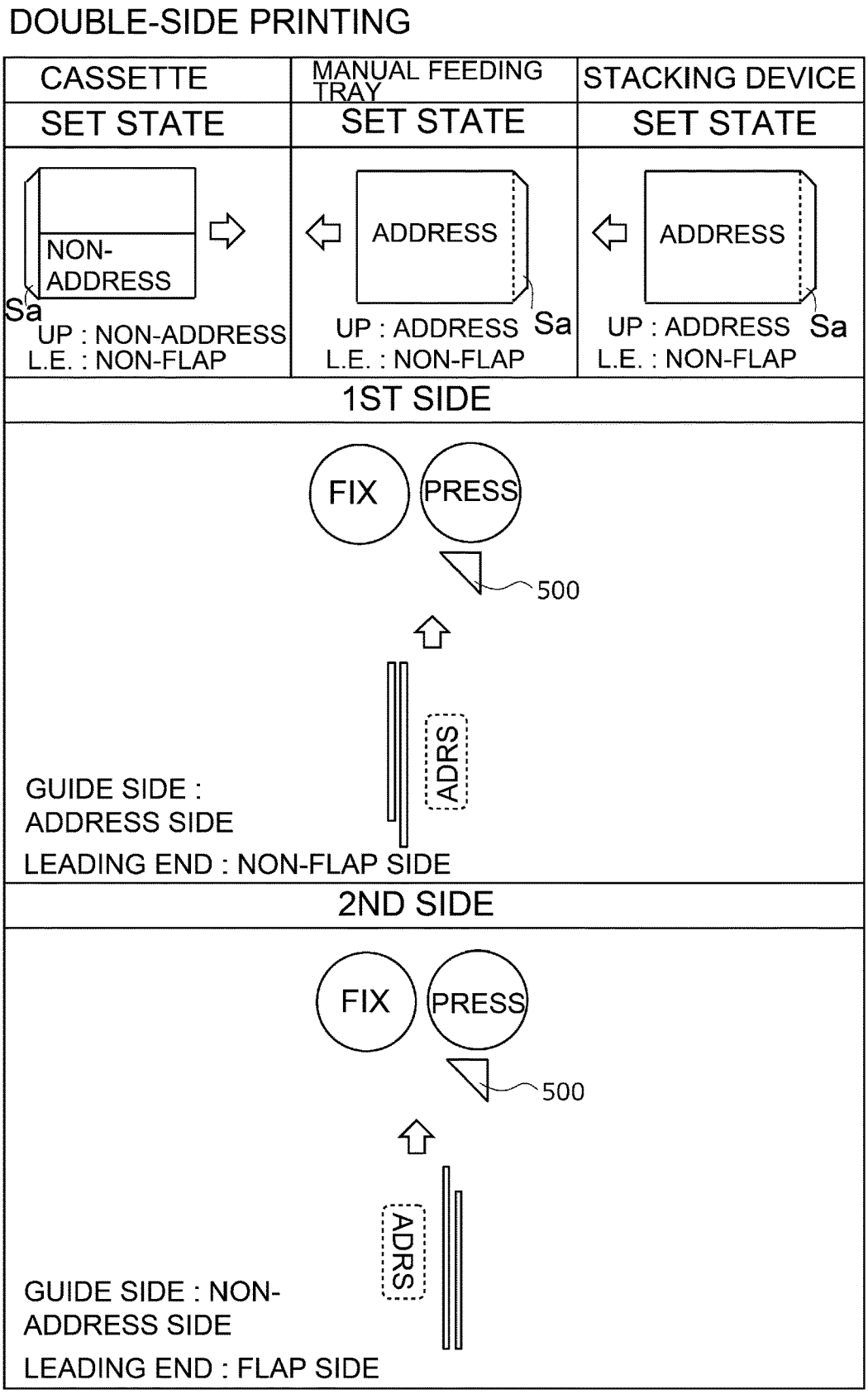

FIG. 17 is a schematic view showing a display example during double-side printing in the vertical feeding type.

Figure 18:
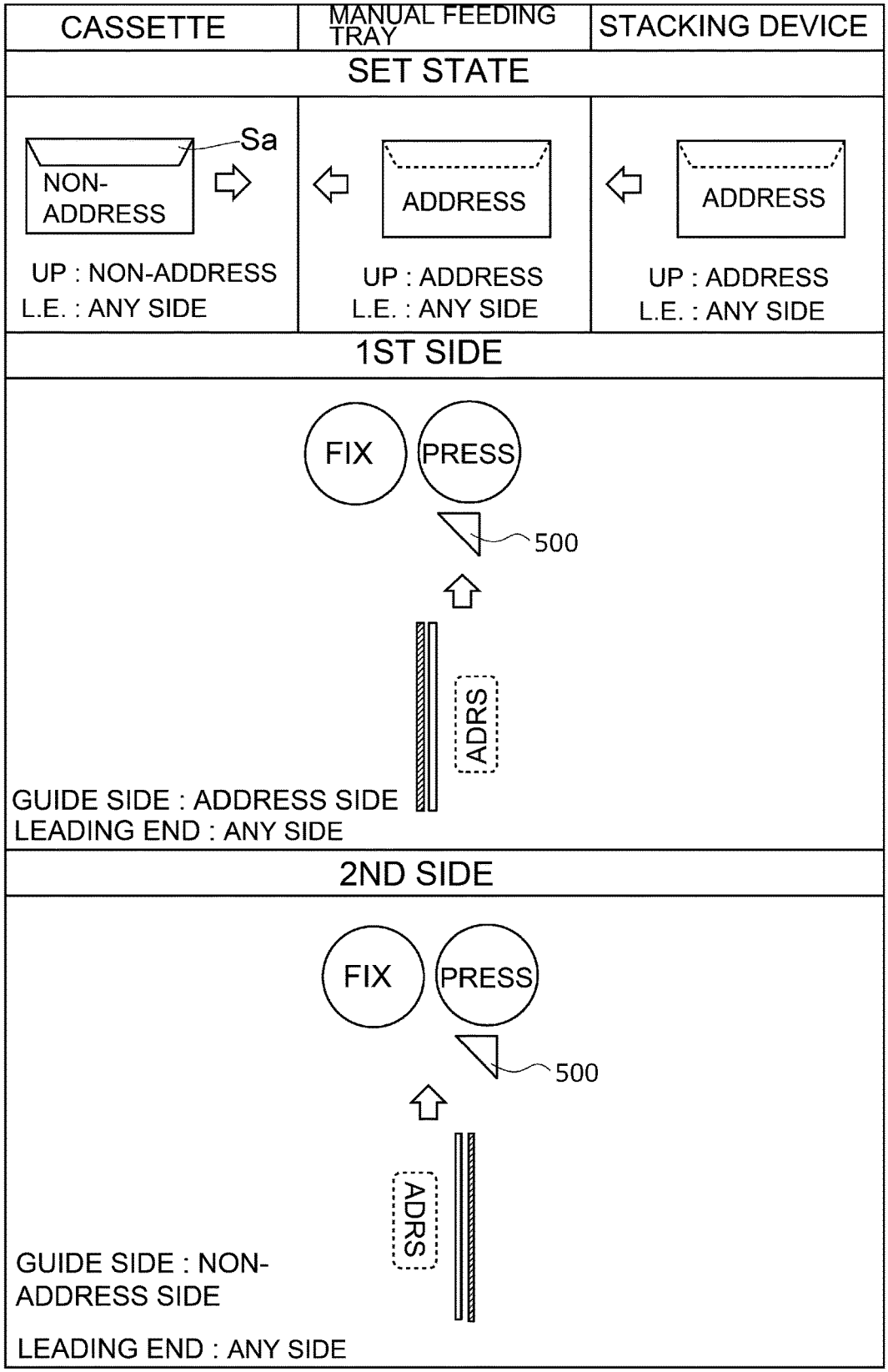

FIG. 18 is a schematic view showing after the display example during double-side printing in the vertical feeding type.

Figure 19:
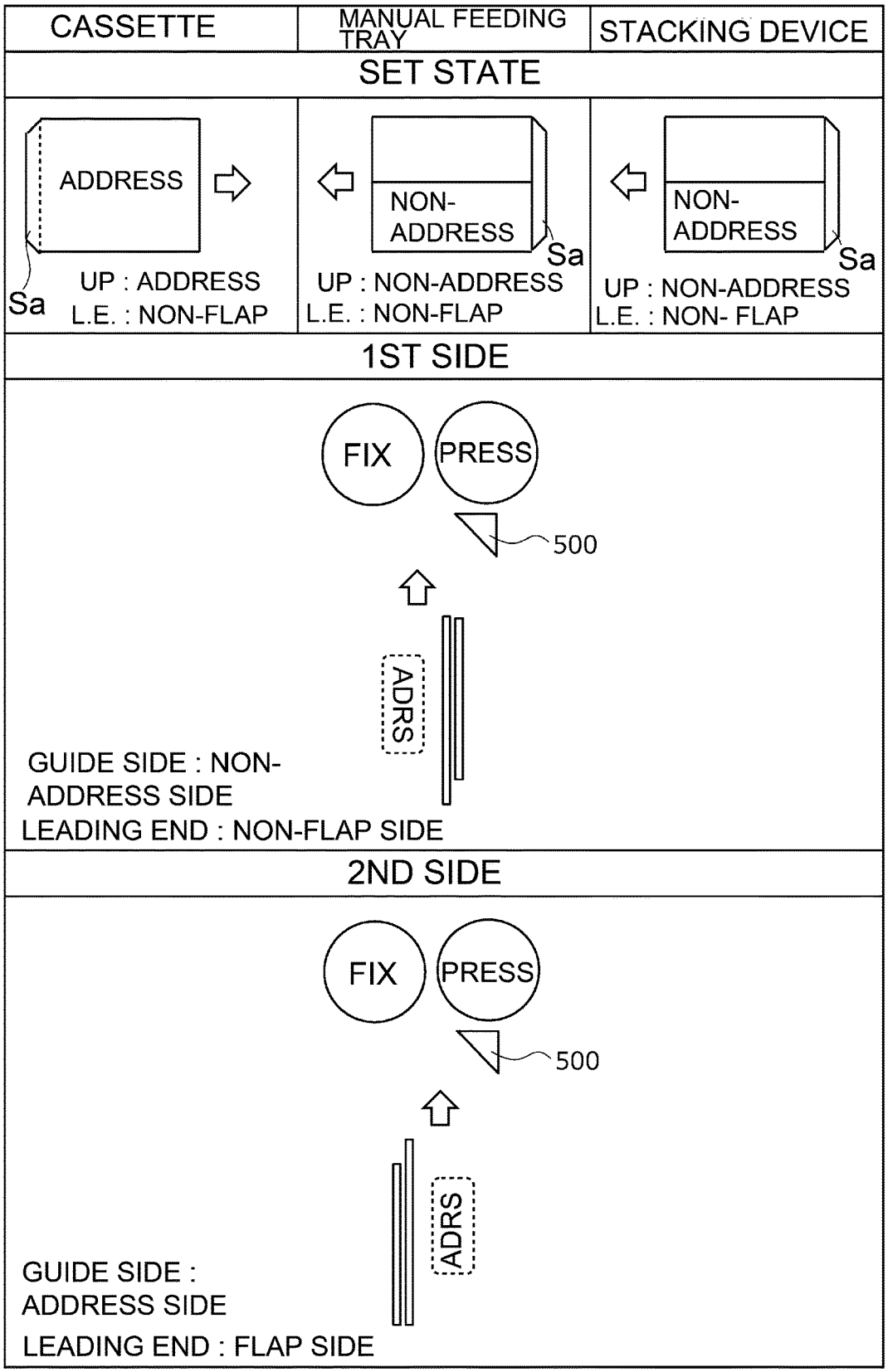

FIG. 19 is a schematic view showing a display example during one-side printing in the vertical feeding type.

Figure 20:
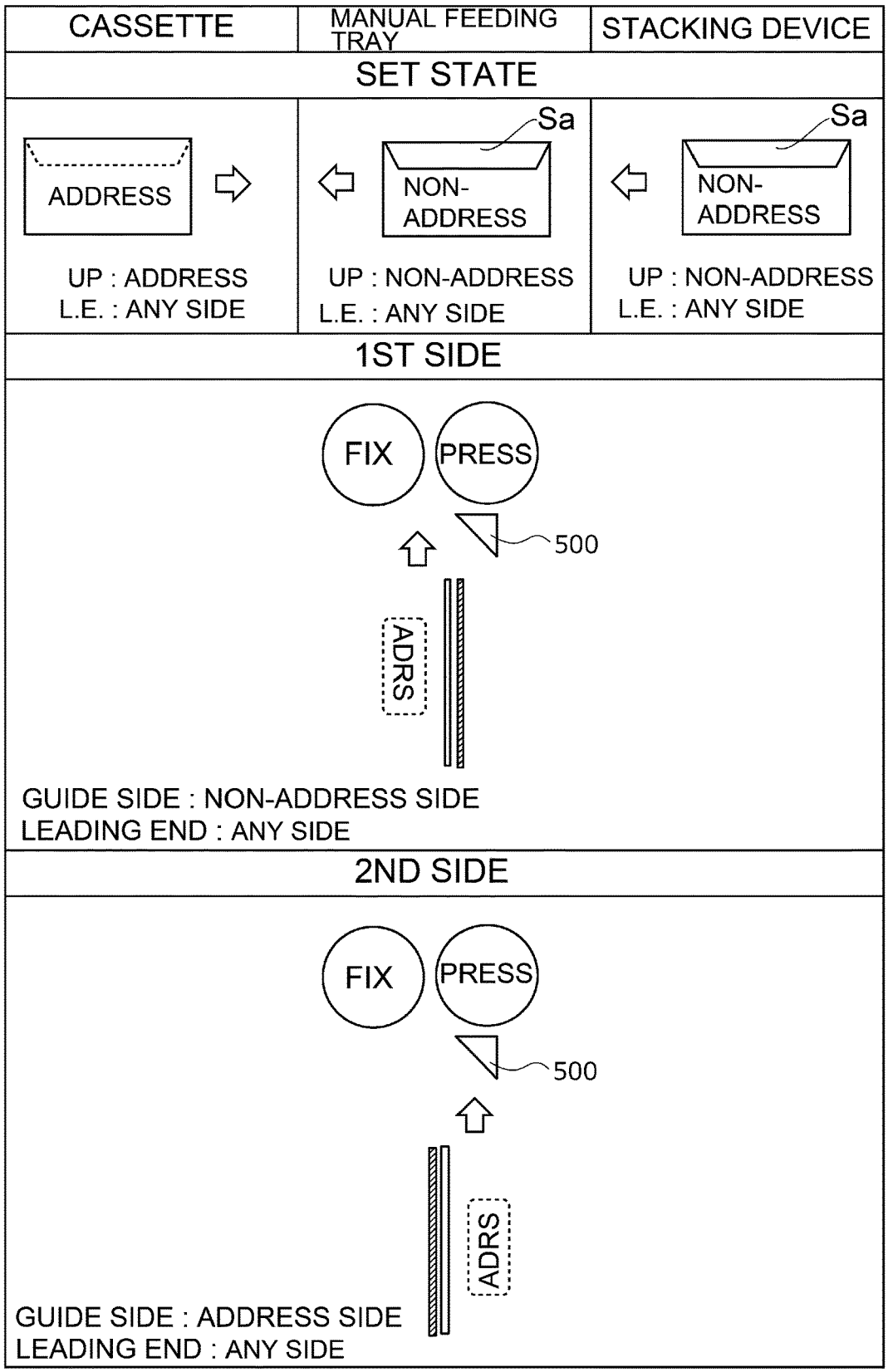

FIG. 20 is a schematic view showing another display example during one-side printing in the vertical feeding type.

Figure 21:
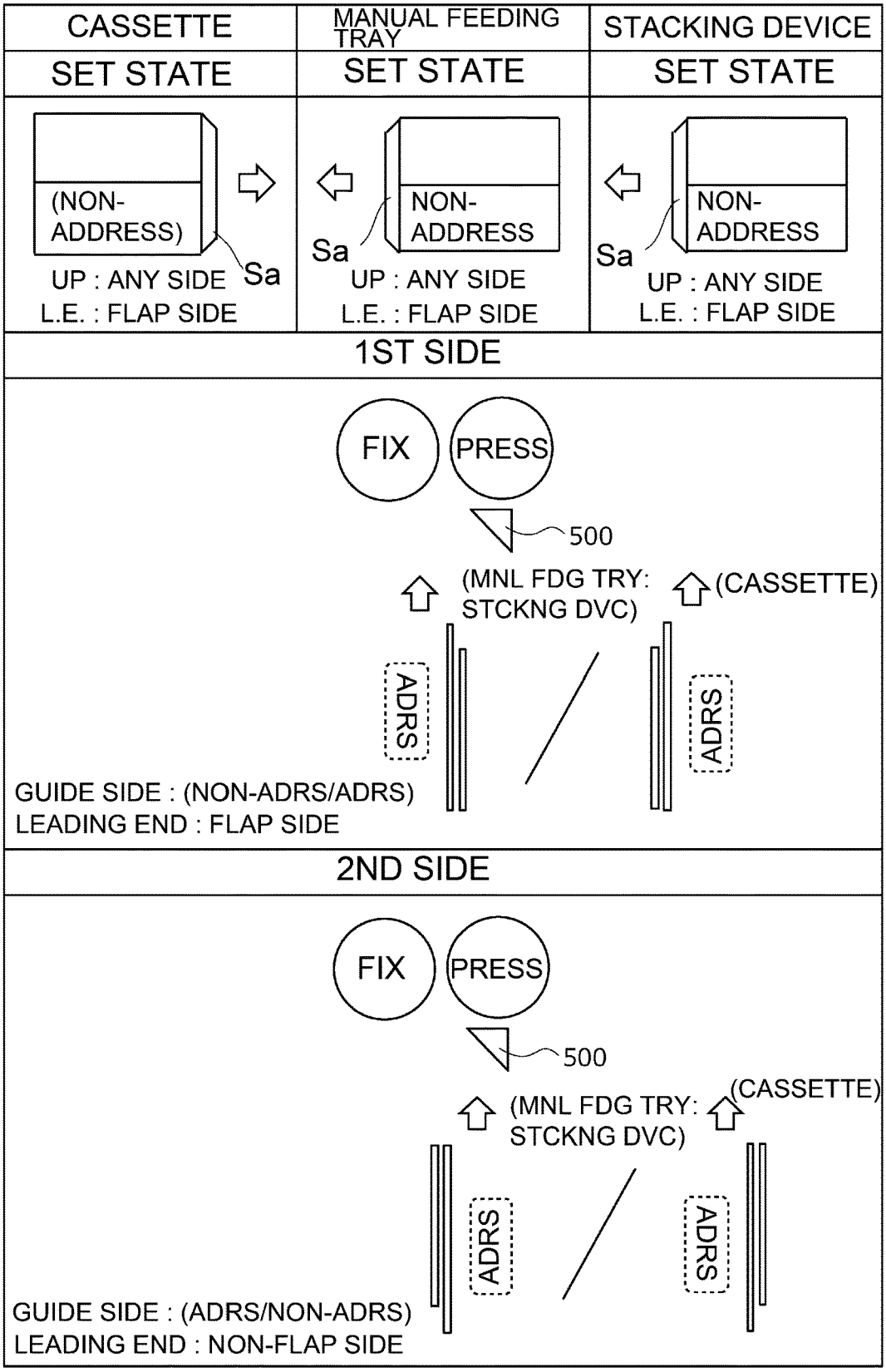

FIG. 21 is a schematic view showing after the display example during double-side printing in the vertical feeding type.

DESCRIPTION OF EMBODIMENTS

<Image Forming Apparatus>

Figure 1:
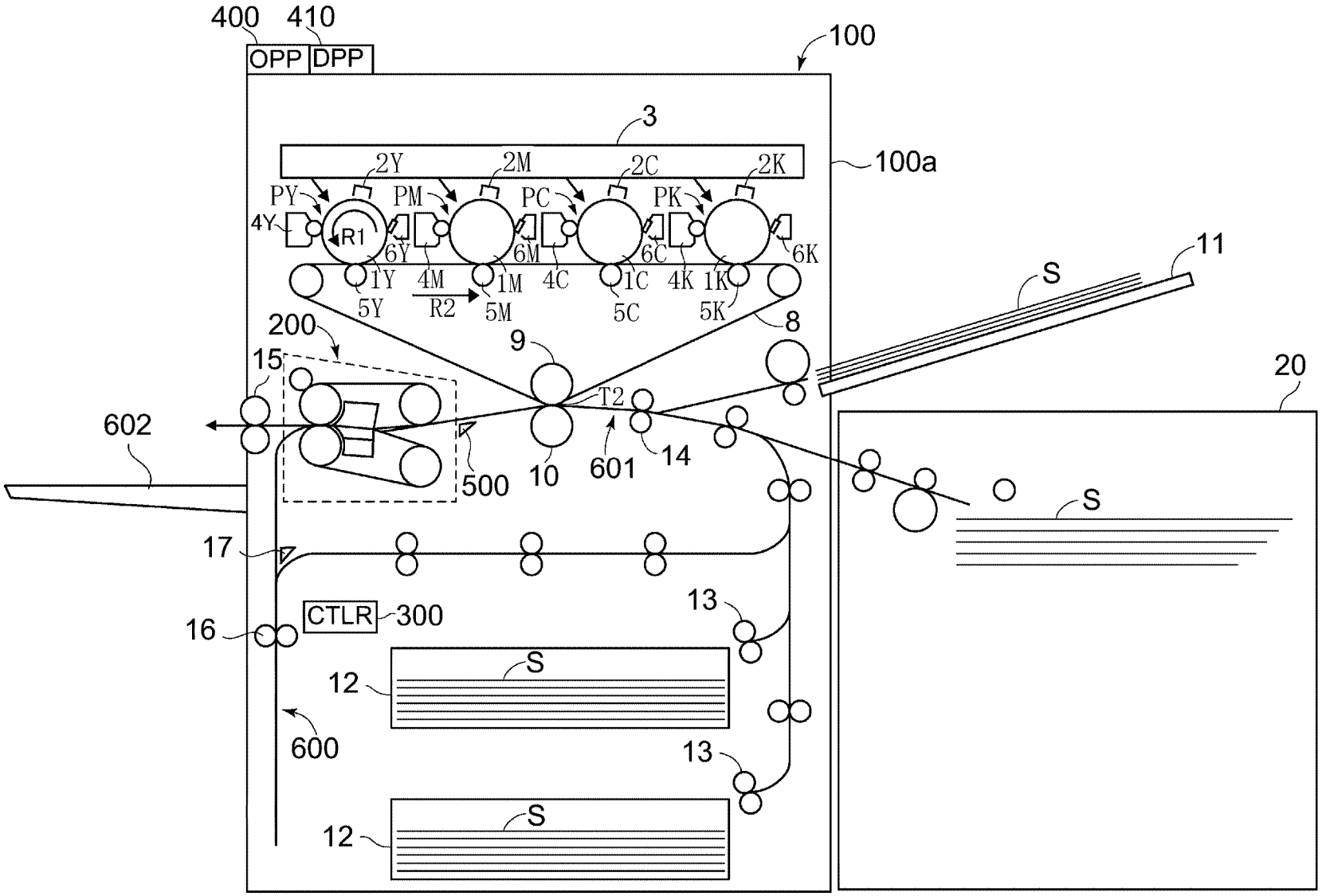
FIG. 1 is a schematic view showing an image forming apparatus of a lateral feeding type to which a control device in an embodiment is applicable.

A control device in an embodiment will be described. First, an image forming apparatus of a lateral (horizontal) feeding type to which the control device in this embodiment is applicable will be described using FIG. 1. An image forming apparatus 100 shown in FIG. 1 is a tandem full-color printer of an electrophotographic type. The image forming apparatus 100 includes image forming portions PY, PM, PC and PK for forming images of yellow, magenta, cyan and black, respectively. The image forming apparatus 100 forms a toner image on a recording material depending on an image signal from an original reading device (not shown) connected to an apparatus main assembly 100*a* or from an external device, such as a personal computer, communicatably connected to the apparatus main assembly 100*a*. In this embodiment, the image forming apparatus 100 is capable of forming the toner image on an envelope S which is the recording material.

As shown in FIG. 1, the image forming portions PY, PM, PC and PK are arranged in the apparatus main assembly 100*a* along a movement direction of an intermediary transfer belt 8. The intermediary transfer belt 8 is stretched by a plurality of rollers and is constituted so as to travel in an arrow R2 direction. The intermediary transfer belt 8 carries and feeds toner images which are primary-transferred thereon. At a position opposing, through the intermediary transfer belt 8, a secondary transfer inner roller 9 for stretching the intermediary transfer belt 8, a secondary transfer outer roller 10 is provided and constitutes a secondary transfer portion T2 where the toner images are transferred from the intermediary transfer belt 8 onto the envelope S. On a side downstream of the secondary transfer portion T2 with respect to a recording material feeding direction, a fixing device 200 is provided. Incidentally, in the case of this embodiment, the image forming portion PY to PK, the intermediary transfer belt 8, a secondary transfer inner roller 9 and the secondary transfer outer roller 10 are an example of an image forming unit capable of forming the toner image on the envelope S.

At a lower portion of the image forming apparatus 100, a cassette 12 in which envelopes S are stacked. Each of the envelopes S is supplied from the cassette 12 to a feeding passage 601 by a feeding roller pair 13. Thereafter, a registration roller pair 14 is started to the rotated in synchronism with the toner images formed on the intermediary transfer belt 8 as described later, so that the envelope S is fed to the secondary transfer portion T2. Incidentally, the cassette 12 may also be provided in plurality so that envelopes different in size and thickness can be stacked on the plurality of cassettes 12, and in that case, the envelope S is selectively fed from either one of the plurality (two in this embodiment) of cassettes 12. Further, the envelope S is not limited to the envelopes S stacked on the cassettes 12, and the envelope S stacked on a manual feeding tray 11 may also be fed or the envelope S stacked in a stacking device 20 connected to the apparatus main assembly 100*a* may also be fed. Incidentally, in this embodiment, the envelope S on the manual feeding tray 11 or in the stacking device 20 (corresponding to a first stacking portion) is fed to the secondary transfer portion T2 while being kept in a stacked state so that the toner image is formed on an upper surface side. On the other hand, the envelope S in the cassette 12 (corresponding to a second stacking portion) is fed to the secondary transfer potion T2 while being in a stacked state so that the toner image is formed on a lower surface side.

The four image forming portions PY, PM, PC and PK substantially have the same constitution except that development colors are different from each other. Accordingly, in this embodiment, as a representative, the image forming portion PY for yellow will be described, and other image forming portions will be omitted from description. In the image forming portion PY, a photosensitive drum 1Y is provided. The photosensitive drum 1Y is rotationally driven in an arrow R1 direction. At a periphery of the photosensitive drum 1Y, a charging device 2Y, an exposure device 3, a developing device 4Y, a primary transfer roller 5Y and a cleaning device 6Y are provided.

In the case where an image forming operation is started, first, a surface of the rotating photosensitive drum 1Y is electrically charged uniformly by the charging device 2Y. The charging device 2Y is, for example, a corona charger for charging the photosensitive drum 1Y uniformly to a negative dark-portion potential by irradiating the photosensitive drum 1Y with charged particles with corona discharge. Then, the photosensitive drum 1Y is subjected to scanning exposure to laser light, corresponding to an image signal, emitted from the exposure device 3. As a result, an electrostatic latent image depending on the image signal is formed on the surface of the photosensitive drum 1Y. The electrostatic latent image formed on the photosensitive drum 1Y is visualized by toner (developer) accommodated in the developing device 4Y, so that the toner image which is a visible image is formed.

The toner image formed on the photosensitive drum 1Y is primary-transferred onto the intermediary transfer belt 8 at a primary transfer portion constituted between the photosensitive drum 1Y and the intermediary transfer belt 8 urged by the primary transfer roller 5Y. At this time, to the primary transfer roller 5Y, a primary transfer bias is applied. The toner remaining on the surface of the photosensitive drum 1Y after the primary transfer is removed by the cleaning device 6Y.

Such an operation is successively performed in the respective image forming portions PY to PK for yellow, magenta, cyan and black, respectively, so that four color toner images are superposed on each other. Therefore, in synchronism with toner image formation, the envelope S stacked on the manual feeding tray 11, the cassette 12 or the stacking device 20 is fed to the secondary transfer portion T2 through the feeding passage 601. Then, by applying a secondary transfer bias to the secondary transfer outer roller 10, a full-color toner image formed on the intermediary transfer belt 8 is secondary-transferred onto the envelope S.

Then, the envelope S passed through the secondary transfer roller T2 is supported by a guiding member 500 and is fed toward a fixing device 200. The guiding member 500 guides the envelope S toward the guiding member 500 while supporting the envelope S on a side opposite from a side where the toner image is formed during passing of the envelope S through the secondary transfer portion T2 immediately before guidance of the envelope S by the guiding member 500. In the fixing device 200 as a fixing portion, the toner image is heated and pressed with nip-feeding of the envelope S, so that the toner image is fixed on the envelope S.

<Fixing Device>

Figure 2:
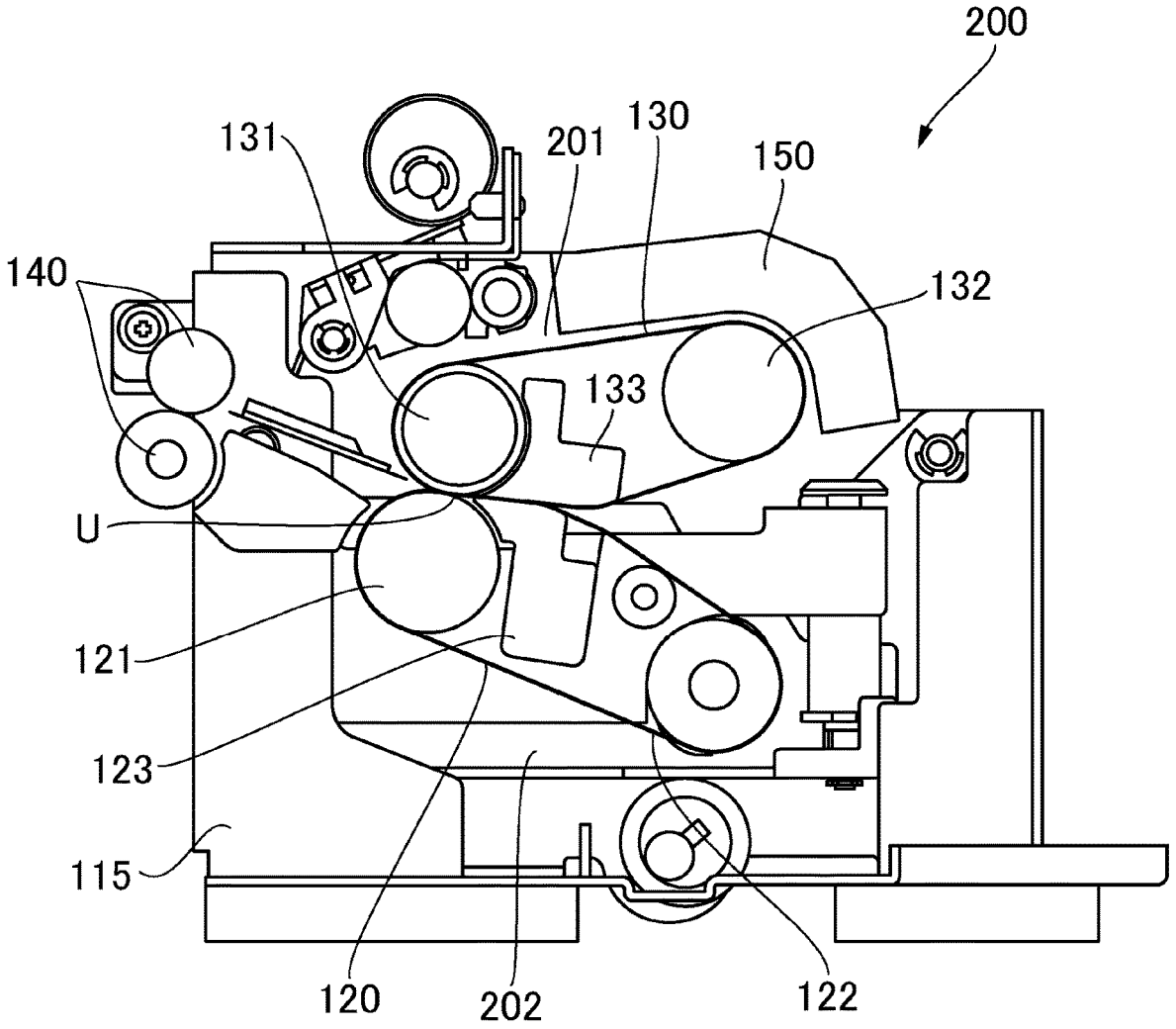
FIG. 2 is a schematic view showing an example of a fixing device.

The fixing device 200 will be described using FIG. 2. The fixing device 200 shown in FIG. 2 is a fixing device of a twin belt type. This fixing device 200 forms a fixing nip U by causing an endless pressing belt 120 assembled with a lower frame 202 to be press-contacted to an endless heating belt 130 assembled with an upper frame 201. The heating belt 130 is extended around a driving roller 131 and a tension roller 132, which are shaft-supported by a frame 115, with predetermined tension, and is circulated and rotated by rotation of the driving roller 131. The driving roller 131 has a function of generating pressure at the fixing nip U by supporting an inner surface of the heating belt 130, and the tension roller 132 has a function of imparting belt tension to the heating belt 130. Inside the heating belt 130, a fixing pad 133 formed of stainless steel, for example, is provided. The fixing pad 133 presses the heating belt 130 toward a pressing pad 123 with predetermined pressure, and thus forms the fixing nip U in combination with the driving roller 131.

In the fixing device 200, the heating belt 130 is heated by an induction heating device 150 (for example, an IH heater) through electromagnetic induction heating. The induction heating device 150 is provided so as to provide a predetermined gap between itself and another peripheral surface of the heating belt 130. The induction heating device 150 includes, although omitted from illustration, for example, an exciting coil prepared by winding electric wire such as Litz wire, and an outside magnetic core. The exciting coil generates an AC magnetic field (magnetic flux) when an alternating current is applied thereto. The exciting coil generates the AC magnetic field, so that the heating belt 130 is induction-heated. Further, in order to induction-heat the heating belt 130 efficiently, the outside magnetic core, formed with a high-permeability member such as ferrite capable of shielding the AC magnetic field, is provided so as to cover the exciting coil.

On the other hand, the pressing belt 120 is extended around a pressing roller 121 shaft-supported by the lower frame 202 and a tension roller 122 with predetermined tension and is rotated by the rotation of the heating belt 130. Inside the pressing belt 120, the pressing pad 123 formed of a silicone rubber, for example, is disposed. The pressing pad 123 presses the pressing belt 120 toward the fixing pad 133 with predetermined pressure, and thus forms the fixing nip U in combination with the pressing roller 121. Then, when the envelope S passes through the fixing nip U, the envelope S is discharged to an outside of the fixing device 200 by a fixing discharging roller pair 140.

Returning to FIG. 1, the image forming apparatus 100 is capable of printing images on both sides (surfaces) of the envelope S. In the case of one-side printing, the envelope S on which the toner image is fixed on one side thereof is discharged by a discharging roller pair 15 on a discharge tray 602 provided outside the apparatus main assembly 100*a*. On the other hand, in the case of double-side printing, the envelope S on which the toner image is fixed on a first (one) side is fed by a normally rotating feeding roller pair 16 toward a double-side feeding passage 600 in order to form a toner image on a second side subsequently to the fixing of the toner image on the first side. Then, the feeding roller pair 16 is reversely rotated with timing when a trailing end of the envelope S with respect to a recording material (envelope) feeding direction reaches a switching portion 17. Leading and trailing ends of the envelope S are changed to each other in the double-side feeding passage 600 by the reverse rotation of the feeding roller pair 16 and is fed again along the feeding passage 601 toward the registration roller pair 14 (so-called, switch-back feeding). In this case, the envelope S to be fed again along the feeding passage 601 is switched (reversed) between the first side and the second side thereof so that the other side (the second side opposite from the first side) where the toner image is not fixed at the secondary transfer portion T2 faces toward the intermediary transfer belt 8 side. Thereafter, the envelope S is subjected to the process similar to the process in the case of the one-side printing, and thus the toner image is fixed on the second side thereof, and then is discharged the discharging roller pair 15 on the discharge tray 602 disposed outside the apparatus main assembly 100*a*. Incidentally, a portion constituted by the double-side feeding passage 600, the discharging roller pair 15 and the switching portion 17 is an example of a feeding mechanism for feeding the envelope S in an automatic reversing manner.

<Controller>

Figure 3:
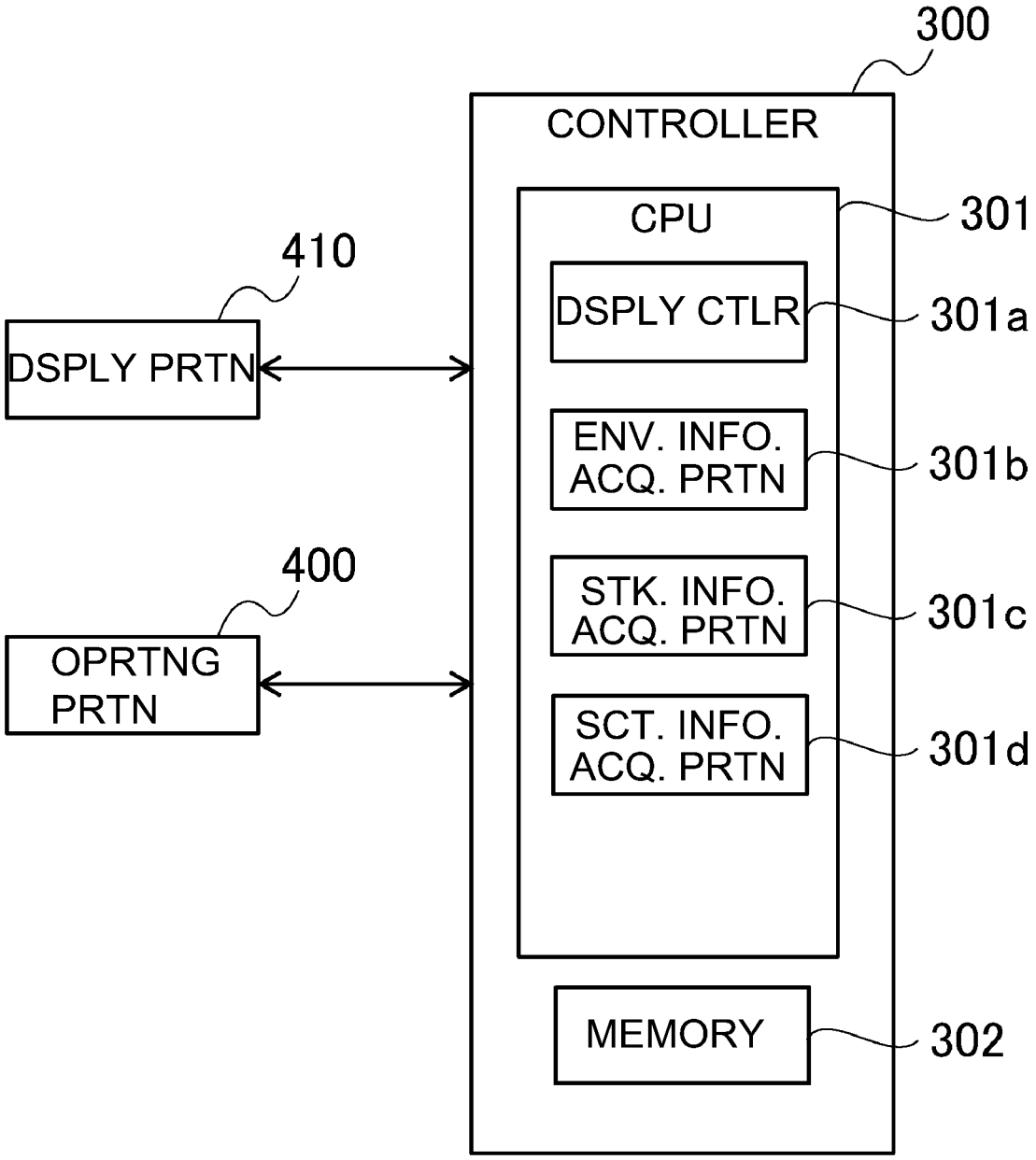
FIG. 3 is a control block diagram for illustrating a controller.

As shown in FIG. 1, the image forming apparatus 100 of this embodiment includes a controller 300 as a controlling device. The controller 300 will be described using FIG. 3. As shown in FIG. 3, the controller 300 includes a CPU 301 (central processing unit) and a memory 302 such as a ROM (read only memory) or a RAM (random access memory). In the memory 302, for example, various programs such as a display control program (FIG. 8 described later) and an image forming job, and various data such as envelope information and stacking portion information which are described later, and the like are capable of being stored. The CPU 301 is capable of executing the various programs stored in the memory 302. Incidentally, the memory 302 is also capable of temporarily storing a calculation process result with execution of the various programs.

In the case of this embodiment, the CPU 301 is capable of carrying out display control of a display portion 410 connected to the image forming apparatus 100 by executing the display control program in advance of execution of the image forming job. Incidentally, the display control program is not limited to the form of a software program, but may also be executable in the form of a micro program processed by a DSP (digital signal processor), for example. That is, as regards the CPU 301, one for carrying out various pieces of control such as an image forming operation by executing a control program such as the image forming job may also be used in combination, but the CPU 301 is not limited thereto. A CPU prepared exclusively for executing the display control program may also be used.

To this CPU 301, an operating portion 400 and the display portion 410 are connected via communication busses (for example, data and address busses). The operating portion 400 is, for example, an operating panel, an external terminal or the like for receiving an execution start operation, by a user, of the various programs such as the image forming job and receiving various data inputting operations by the user and the like operation. The operating portion 400 includes, as described later (FIG. 4), various operating elements such as operating keys and operating buttons through which the operating portion 400 receives U's input. The display portion 410 is capable of appropriately displaying various screens such as an input screen (FIG. 5) for inputting various data relating to the envelope S on which the image is printed. In the case of this embodiment, the display portion 410 is a display of a so-called touch panel type in which various phantom operating elements are displayed and input of various data by the user depending on a touch operation to the phantom operating elements by the user. Incidentally, the display portion 410 is not limited to the display provided to the apparatus main assembly 100*a*, but may also be, for example, an external display connected to the apparatus main assembly 100*a* or a display of an external terminal such as a personal computer. Further, the display portion 410 may also be connected to the image forming apparatus 100 through cable (wire) connection or wireless connection if the display portion 410 is capable of communicating with the image forming apparatus 100.

<Operating Portion>

Figure 4:
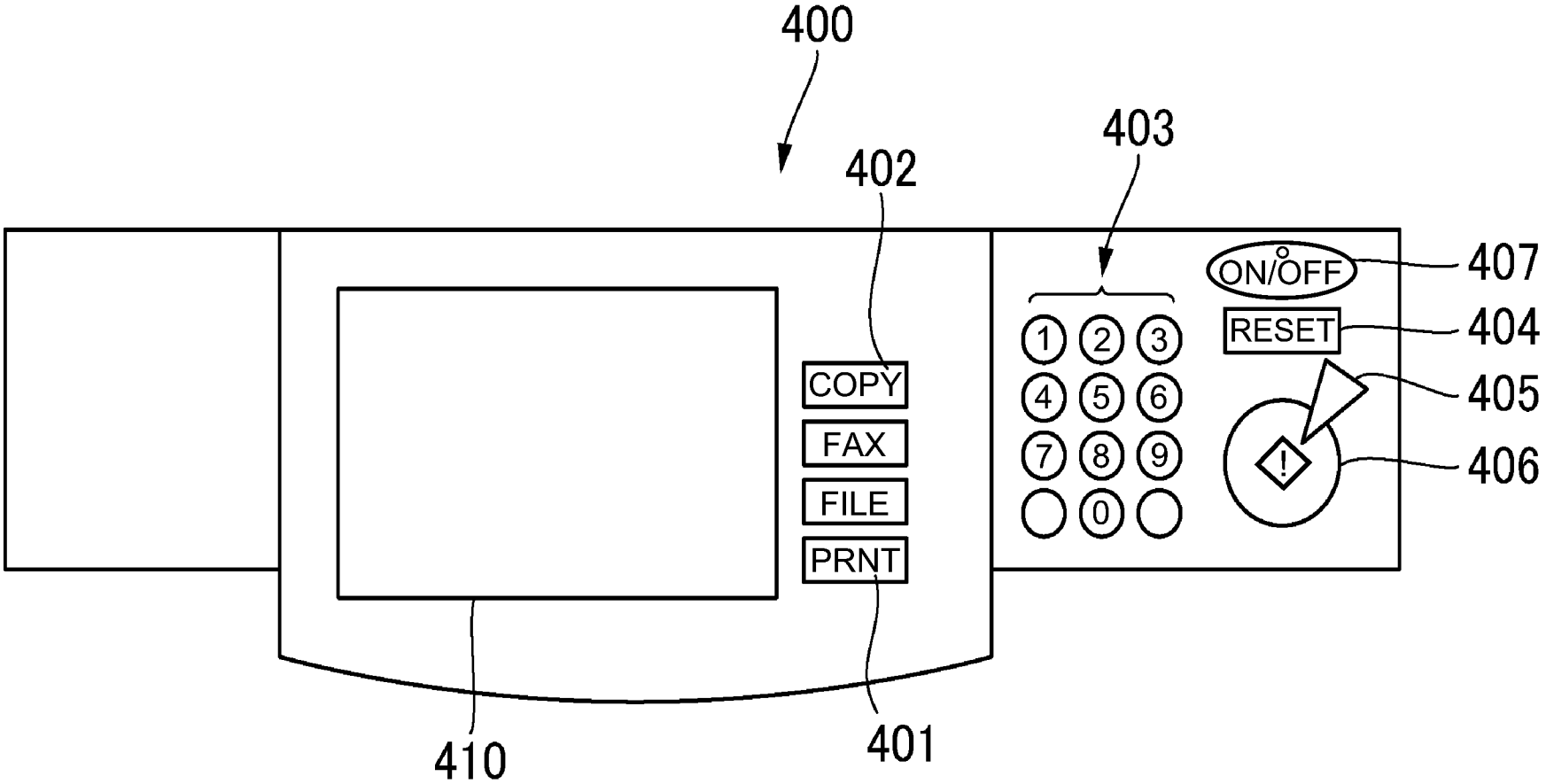
FIG. 4 is a schematic view showing an operating portion.

FIG. 4 shows an example of the operating portion 400. As shown in FIG. 4, the operating portion 400 is provided with various operating elements such as a printer key 401, a copy mode key 402, a numeric keypad 403, a reset key 404, a stop key 405, a start key 406, and a power (on/off) switch 407. The printer key 401 is used for inputting various data relating to normal printing. The copy mode key 402 is used for inputting various data relating to copy printing in the case where the image forming apparatus 100 is used as a copying machine (copy mode). In the case where the printer key 401 or the copy mode key 402 are operated, for example, an input screen for inputting the various data is displayed at the display portion 410. The numeric keypad 403 is used for inputting information on a numerical value such as print number, for example. The reset key 404 is used for resetting inputted various data by operation of the respective keys, to initial values. The stop key 405 is used for forcedly stopping the image forming job during execution, for example. The start key 406 is used for providing on instruction to start the execution of the image forming job including a reading operation of an original image during an operation in a copy mode). The power switch 407 is used for turning on/off a power source of the image forming apparatus 100.

<Input Screen>

Figure 5:
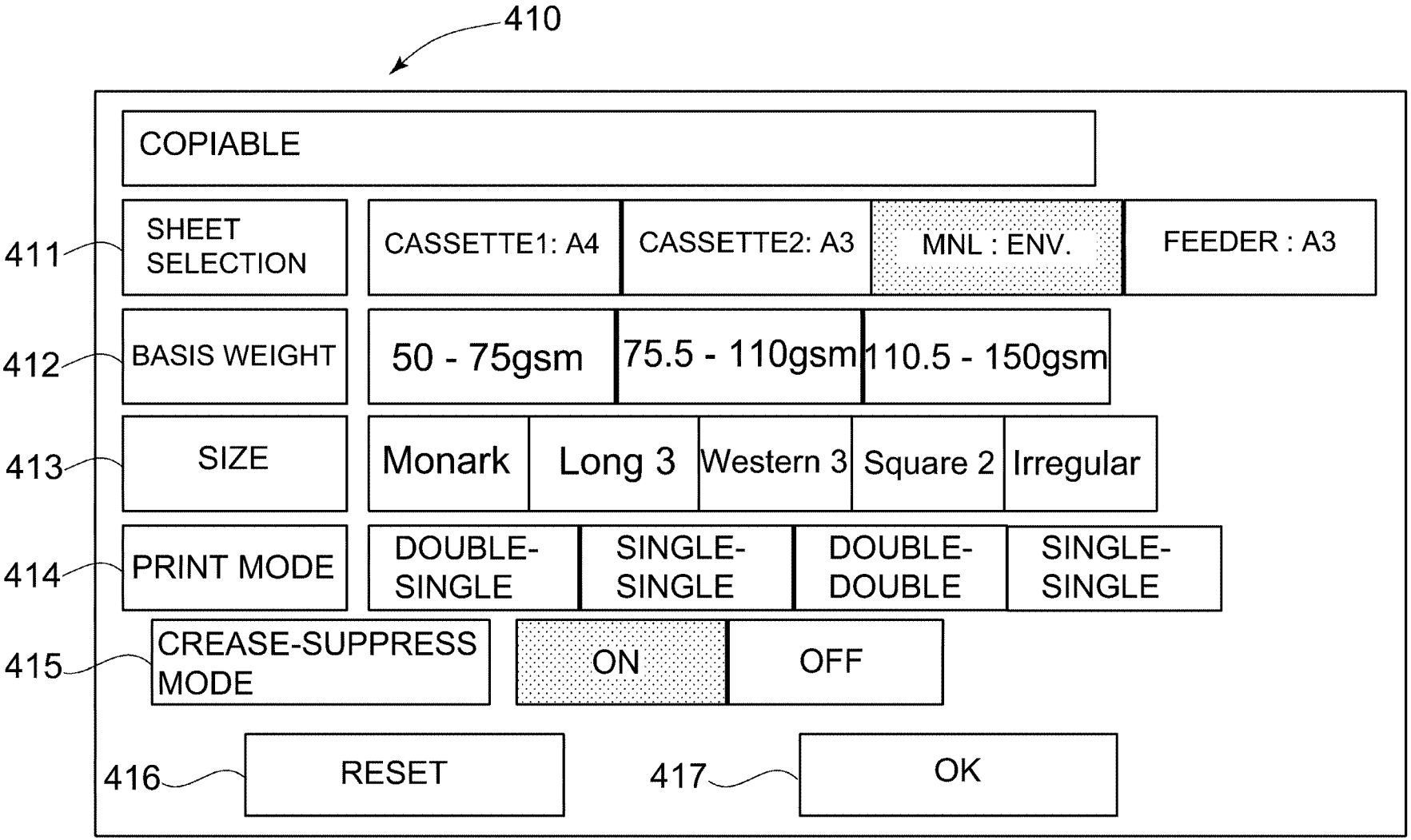
FIG. 5 is a schematic view showing an input screen.

FIG. 5 shows an example of an input screen displayed at the display portion 410. However, in FIG. 5, the case where the image forming apparatus 100 is used as the copying machine (copy mode) was shown as an example. In order to indicate the copy mode, on the input screen shown in FIG. 5, "COPIABLE" is displayed. On this input screen, as the phantom operating elements, a sheet selection key 411, a basis weight selection key 412, a size selection key 413, a print mode key 414, a crease suppressing mode key 415, a reset (setting release) key 416, an OK key 417 are displayed. The user is capable of selectively inputting the various data relating to the printing by using these phantom operating elements displayed at the display portion 410. These phantom operating keys are reverse-displayed every operation by the user. As a result, the user can know that selection of information on display contents associated with the operated phantom operating element was made. Incidentally, the phantom operating elements shown in FIG. 5 are an example, and are not limited thereto.

The sheet selection key 411 is used for inputting either one of the cassette 12, the manual feeding tray 11 and the stacking device (sheet feeding device) 20. Either one of the cassette 12, the manual feeding tray 11 and the stacking device 20 (hereinafter, these are also referred to as stacking portions) inputted by the sheet selection key 411 is stored in the memory 302 (FIG. 3). In this example, the case where "MANUAL FEEDING TRAY: ENVELOPE" is selected for stacking the envelope S on the manual feeding tray 11 and for printing the image on the surface was shown.

The basis weight selection key 412 is used for inputting a basis weight of the envelope S. The size selection key 413 is used for inputting a size (kind) of the envelope S stacked on the stacking portion inputted by the sheet selection key 411. In this example, as the size of the envelope S stacked on the manual feeding tray 11, it is possible to input either one of "Monark, Long 3, Western 3, Square 2, Irregular". Incidentally, "Irregular" is inputted as the size of the envelope S, the user input an arbitrary size by using the numeric keypad 403 (FIG. 4) or the like. The thus-inputted size of the envelope S is stored as envelope information in the memory 302.

The print mode key 414 is used for inputting either one of a one (single) side printing mode in which the image is printed on only one (single) side of the recording material and a double-side printing mode in which the images are printed on both (double) sides of the recording material. The user is capable of selecting the one-side printing mode in which the images on both sides of an original are printed on one side of the recording material ("DOUBLE-SINGLE") or in which the image on one side of the original is printed on one side of the recording material ("SINGLE-SINGLE") and the double-side printing mode in which the image on one side of the original is printed on both sides of the recording material ("SINGLE-DOUBLE") or in which the images on both sides of the original are printed on both sides of the recording material ("DOUBLE-DOUBLE"). Although the crease suppressing mode key 415 will be specifically described later, the crease suppressing mode key 415 is selectable only when the double-side printing mode is selected. The reset key 416 is used for resetting (releasing) the information inputted by the operation of each of the above-described keys. The OK key 417 is used for determining the information inputted by the operation of each of above-described keys.

Returning to FIG. 3, the CPU 301 acquires various data inputted through the operating portion 400 and the display portion 410 and causes the memory 302 to store the various data. Then, for example, depending on an actuating operation such as turning-on of the power source (main switch) of the image forming apparatus 100, the CPU 301 reads the display control program (FIG. 8) from the memory 302 and executes the display control program. By executing the display control program, the controller 300 functions as a display controller 301*a*, an envelope information acquiring portion 301*b* and a stacking portion information acquiring portion 301*c*.

The display controller 301*a* controls display at the display portion 410. As display control of the display portion 410, the display controller 301*a* not only causes the display portion 410 to display the above-described input screens but also carries out display control such that in the case where the double-side printing of the images on the both sides of the envelope S is carried out, a stacking method of the envelope S on the cassette 12, the manual feeding tray 11 and the stacking device 20 is displayed at the display portion 410. The envelope information acquiring portion 301*b* acquires envelope information, such as the size of the envelope S, inputted at the operating portion 400 or the display portion 410 and causes the memory 302 to store the enter information. The stacking portion information acquiring portion 301*c* acquires the stacking portion information of the cassette 12, the manual feeding tray 11 or the stacking device 20, on which the envelope S inputted at the display portion 410 is stacked, and causes the memory 302 to store the stacking portion information. The display controller 301*a* causes the display portion 410 to display the stacking method of the envelope S on the basis of the enter information and the stacking portion information which are acquired by the enter information acquiring portion 301*b* and the stacking portion information acquiring portion 301*c*, respectively.

Figure 6:
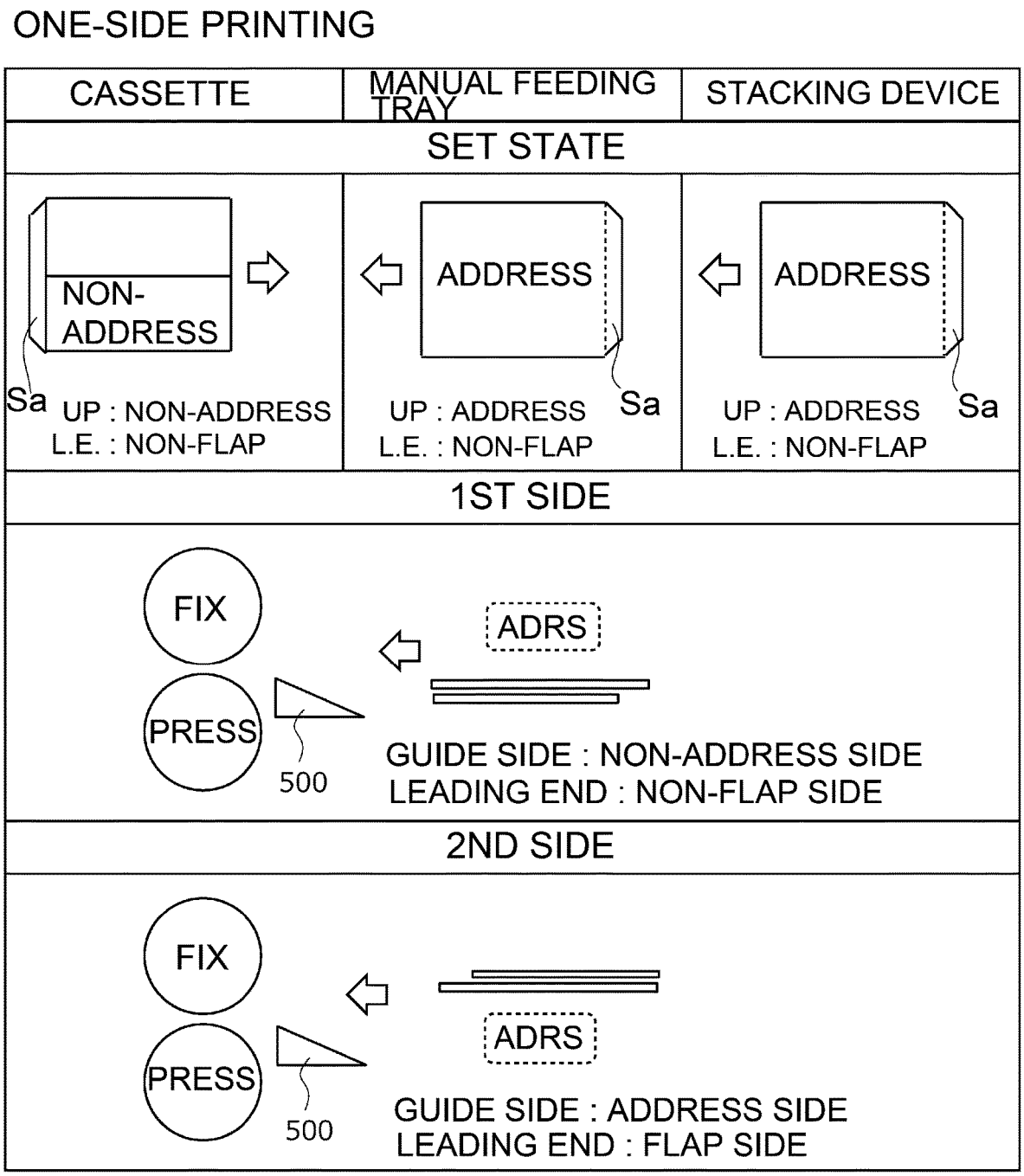
FIG. 6 is a schematic view showing a display example during one-side printing in the lateral feeding type.
Figure 7:
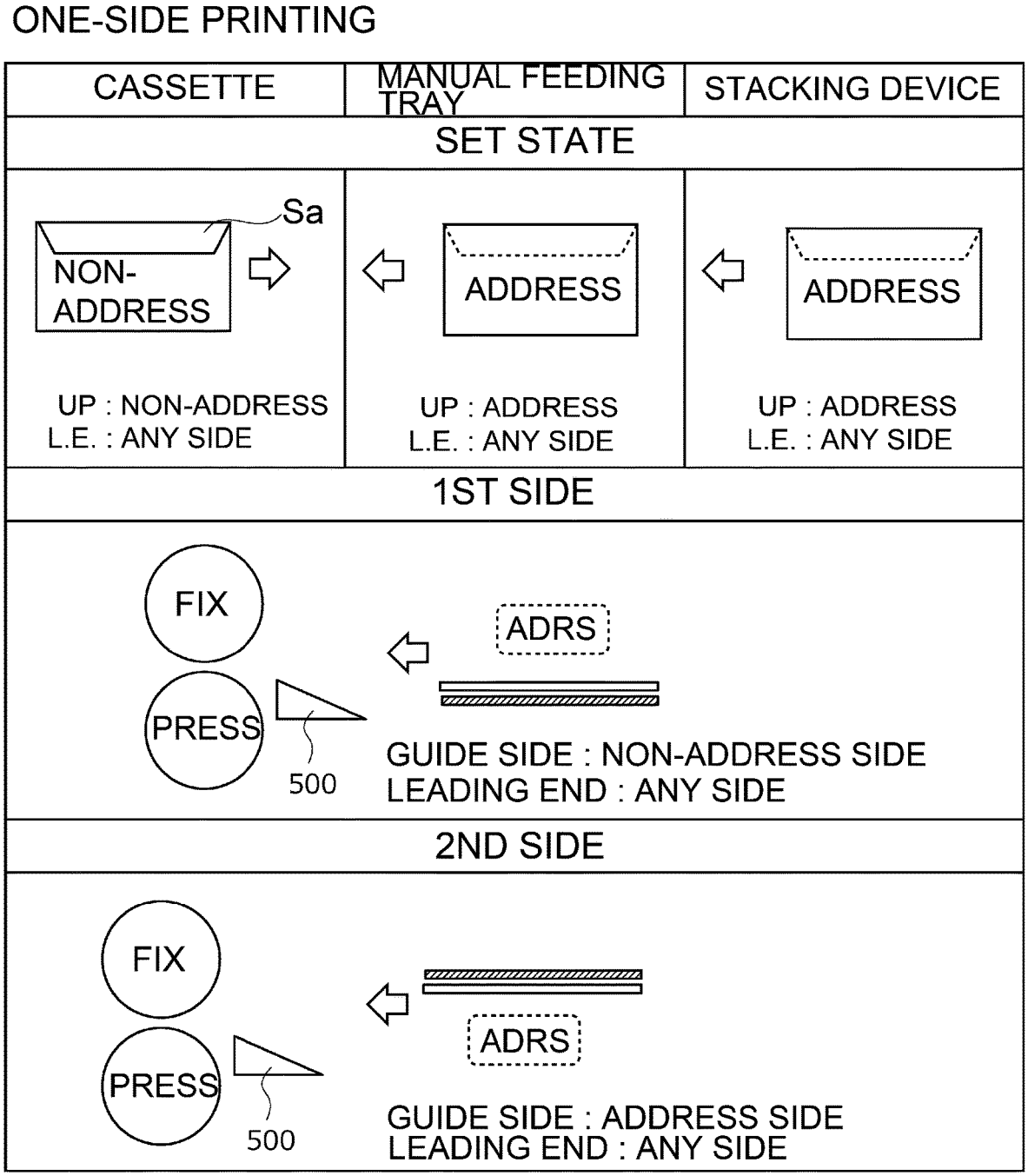
FIG. 7 is a schematic view showing another display example during one-side printing in the lateral feeding type.

Then, a stacking method (set method) of the envelope S displayed during one-side printing with the display control of the display portion 410 by the above-described display controller 301*a* is shown in FIGS. 6 and 7. FIG. 6 is a display example of the case where the envelope S is stacked so that a flap Sa extends along a direction crossing the envelope S feeding direction (arrow direction in the figures).

The envelope S stacked so that the flap Sa extends along the direction crossing the feeding direction is principally an envelope S having a flap on a short side, for example, a Japanese-style envelope such as "Long 3", "Square 2" or the like. In this case, the envelope S is stacked in a state in which the flap Sa is open. FIG. 7 is a display example in which the envelope S is stacked so that a flap Sa extends along the feeding direction. The envelope S stacked so that the flap Sa extends along the feeding direction is principally an envelope S having a flap on a long side, for example, a Western-style envelope such as "Western 3", "Monark" or the like. In this case, the envelope S is stacked in a state in which the flap Sa is closed (folded). Incidentally, even the Japanese-style envelope may also be stacked so that the flap Sa extends along the feeding direction, or even the Western-style envelope may also be stacked so that the flap Sa extends along the direction crossing the feeding direction.

As shown in FIG. 6, in the case where one-side printing of the image on the envelope S having the flap Sa on the short side is carried out, the stacking method of the envelope S is displayed so that the flap Sa extends along the direction crossing the feeding direction. Further, in the case where the envelope S is stacked on the cassette 12, a stacking method in which a short side where those is no flap and the envelope S is closed (i.e., non-flap side) is positioned on a leading end side of the envelope S with respect to the feeding direction and in which a surface side (non-address (surface) side) where the flap Sa is not formed is an upper surface side (facing upward) is displayed. In the case where the envelope S is stacked on the manual feeding tray 11 and the stacking device 30, a stacking method in which the non-flap side is positioned on the leading end side of the envelope S with respect to the feeding direction and in which a surface side (address (surface) side) where the flap Sa is formed is the upper surface side (facing upward) is displayed.

Further, as shown in FIG. 7, in the case where the one-side printing of the image on the envelope S having the flap Sa on the long side, a stacking method of the envelope S is displayed so that the flap Sa extends along the feeding direction. Further, in the case where the envelope S is stacked on the cassette 12, a stacking method in which the non-address (surface) side is the upper surface side is displayed. In the case where the envelope S is stacked on the manual feeding tray 11 and the stacking device 20, a stacking method in which the address (surface) side is the upper surface side is displayed.

Incidentally, conventionally, even during double-side printing, the user has stacked the envelope S in accordance with the above-described stacking methods during one-side printing. In this case, as shown in FIG. 6, even when the envelope S is stacked on any stacking portion, during printing (during toner image formation) on a first (surface) side, the envelope S reaches the fixing device 200 in a state in which the non-flap side is the leading end side of the envelope S with respect to the feeding direction and in which the non-address (surface) side faces a guiding member 500 surface (guiding member side). Then, during printing on a second (surface) side, the envelope S reaches the fixing device 200 in a state in which the short side (flap side) where the flap Sa exists and is not closed (folded) is the leading end side of the envelope S with respect to the feeding direction and in which the address (surface) side faces the guiding member 500 side.

However, the envelope S fed along the double-side feeding passage 600 (FIG. 1) for the double-side printing is capable of being curled by being stiffened or the like when the envelope S passes through a bent path of the double-side feeding passage 600. When curl occurs, the envelope S swells in the neighborhood of the flap Sa, so that the envelope S is liable to become an open state between the front and back thereof. In that state, during printing on the second side, when the envelope S enters the fixing nip U in a state in which the flap side is the leading end side with respect to the feeding direction, compared with the case where the curl does not occur, timing of the envelope S entering the fixing nip U deviates between the first side and the second side (front and back) thereof, so that a speed difference is liable to occur between the front and back of the envelope S. When the speed difference occurs between the front and back of the envelope S, slack (loosening) occurs in the envelope S. Further, the slack occurring in the envelope S can increase on the non-flap side which is the trailing end side with respect to the feeding direction due to pressure with passing of the envelope S through the fixing nip U and is finally liable to cause envelope crease.

On the other hand, in the case where the user stacks the envelope S on the stacking portion during double-side printing, as shown in FIG. 7, even when the envelope S is stacked on any stacking portion, during the printing (toner image formation) on the first side, the envelope S reaches the fixing device 200 in a state in which the non-address side faces the guiding member 500 side. Then, during the printing (toner image formation) on the second side, the envelope S reaches the fixing device 200 in a state in which the address side faces the guiding member 500 side.

However, even in this state, when the curl occurs in the envelope S when the envelope S passes through the bent path of the double-side feeding passage 600, the envelope S is liable to becomes the open state between the front and back thereof. Particularly, in the case where the envelope S is stacked in a closed state of the flap Sa, when the front and back of the envelope S are in the open state, the flap Sa can be moved in a direction in which the flap Sa opens. In that state, during the double-side printing on the second side, when the envelope S enters the fixing nip U, timing when the envelope S enters the fixing nip U deviates between a body of the envelope S and the flap Sa, so that particularly at a portion where the flap Sa exists, a speed difference is liable to be caused between the front and back of the envelope S. When the speed difference occurs between the front and back of the envelope S, slack occurs in the envelope S. Further, the slack occurring in the envelope S can increase on a crease (fold) of the flap Sa due to pressure with passing of the envelope S through the fixing nip U, so that there was a liability that a crease is finally put in the envelope S at a position different from a position of the original crease.

Therefore, in view of the above-described point, in this embodiment, a stacking method of the envelope S is displayed at the display portion 410 during double-side printing. In that case, during the printing on the second side of the envelope S, even when the curl occurs in the envelope S due to automatic reversal, the stacking method of the envelope S was displayed at the display portion 410 so that the envelope S can enter the fixing nip U while suppressing the deviation of the envelope S between the front and back. In the following, a display control process in this embodiment in which such display control is carried out will be described.

<Display Control Process>

Figure 8:
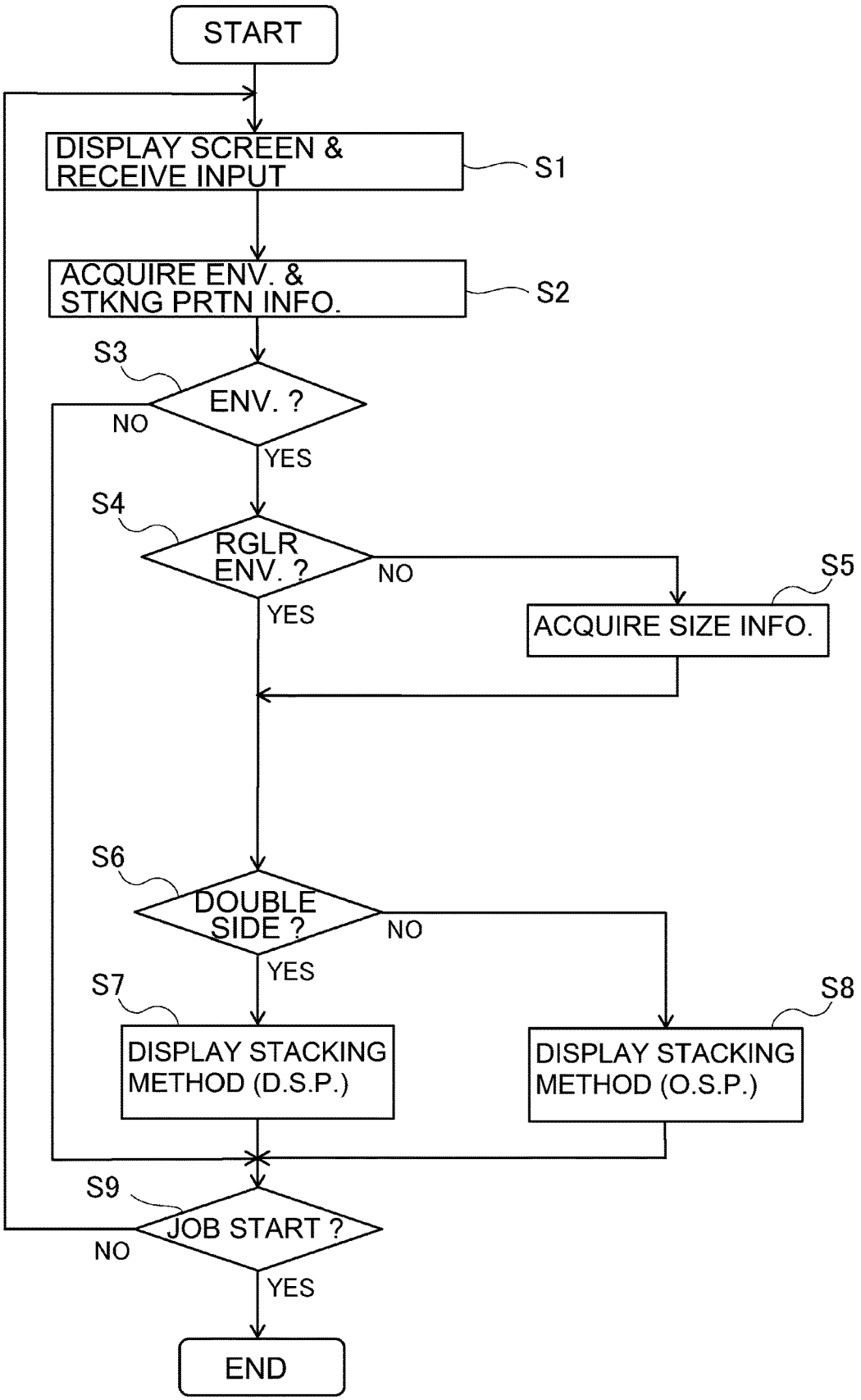
FIG. 8 is a flowchart showing a display control process in the embodiment.

The display control process in this embodiment will be described using FIG. 8 with reference to FIGS. 1 to 7. The display control process in this embodiment is started by the controller 300, for example, in the case where the printer key 401 or the copy mode key 402 of the operating portion 400 is operated by the user, and is ended in the case where the start key 406 of the operating portion 400 is operated, i.e., in response to a start of an image forming job.

The controller 300 causes the display portion 410 to display the above-described input screen (FIG. 5) or the like and receives user input through the displayed input screen (S1). In response to the user input, the controller 300 is capable of acquiring envelope information as a procedure of acquiring the envelope information by the envelope information acquiring portion 301*b* and of acquiring stacking portion information as a procedure of acquiring the stacking portion information by the stacking portion information acquiring portion 301*c* (S2). The controller 300 discriminates whether or not the recording material subjected to printing is the envelope (S3). In the case where the recording material is not the envelope (NO of S3), the controller 300 causes the process to jump to step S9. On the other hand, in the case where the recording material is the envelope (YES of S3), the controller 300 discriminates whether or not the envelope is a regular envelope (S4). In the case where the envelope is not the regular envelope (NO of S4), the controller 300 acquires a size (size input information) of the envelope S inputted by an operation of the numeric keypad 403 of the operating portion 400 (S5). The acquired size input information is stored as partial data of the envelope information in the memory 302.

Then, the controller 300 discriminates whether input is made through the input screen so that the image forming job is executed in an operation in which one of a double-side printing mode and an one-side printing mode (S6). In the case where the one-side printing mode is inputted (NO of S6), the controller 300 causes the display portion 410 to display, as a procedure of displaying the stacking method of the envelope S, a "stacking method during one-side printing" including the above-described envelope images (FIGS. 6 and 7) (S8). On the other hand, in the case where the double-side printing mode is inputted (YES of S6), the controller 300 causes the display portion 410 to display, as the procedure of displaying the stacking method of the envelope S, a "stacking method during double-side printing" including envelope images (FIGS. 10 and 11) described later (S7). Thereafter, the controller 300 discriminates whether or not an instruction to start the image forming job is provided (S9). In the case where the instruction to start the image forming job is not provided (NO of S9), the controller 300 repeats the above-described processes of S1 to S8. In the case where the instruction to start the image forming job is provided (YES of S9), the controller 300 ends the display control process.

<Display Example of Envelope Stacking Method>

As an example, in the case where an envelope S with a flap Sa (for example, Square 2) on a short side is stacked on the manual feeding tray 11, a display example of the "stacking method during one-side printing" (S8) is shown in part (a) of FIG. 9, and a display example of the "stacking method during double-side printing" (S7) is shown in part (b) of FIG. 9. In the case of this embodiment, at the display portion 410, the stacking method of the envelope S is displayed by character information for illustrating the envelope stacking method with characters and by image information for illustrating the envelope stacking method with an envelope image including a direction (orientation) of the flap Sa of the envelope S and the front and back of the envelope S.

As can be understood by comparing parts (a) of FIG. 9 and part (b) of FIG. 9 with each other, display of the "stacking method during one-side printing" and the "stacking method during double-side printing" are different from each other. Specifically, in the "stacking method during one-side printing" shown in part (a) of FIG. 9, the stacking method of the envelope S is displayed so that the address side (side where the flap is formed) faces upward and so that the flap Sa is the trailing end side of the envelope S with respect to the feeding direction. On the other hand, in the "stacking method during double-side printing" shown in part (b) of FIG. 9, the stacking method of the envelope S is displayed so that the non-address side (side where the flap is not formed) faces upward and so that the flap Sa is the trailing end side of the envelope S with respect to the feeding direction.

In FIG. 10, a display example of the case where as regards the "stacking method during double-side printing", the envelope S (for example, Square 2) with the flap Sa on the short side is stacked on the cassette 12 and the stacking device 20 so that the flap Sa extends along the direction crossing the feeding direction is shown. As shown in FIG. 10, in the case where the envelope S is stacked on the cassette 12, the stacking method in which the address side is the upper surface side is displayed. In the case where the envelope S is stacked on the stacking device 20, similarly as in the case of the manual feeding tray 11, the stacking method in which the non-address side is the upper surface side is displayed. Further, in this example, display is made so that the non-flap side is the leading end side with respect to the feeding direction.

In the case of this embodiment as shown in FIG. 10, even when the envelope S is stacked on any stacking portion, during the printing (toner image formation) on the second side, the envelope S reaches the fixing device 200 in a state in which the flap side is the leading end side with respect to the feeding direction and in which the non-address side faces the guiding member 500 side. In this case, when the envelope S reaches the fixing device 200, first, the flap Sa enters the fixing nip U and then the leading end of the envelope S on the non-address side enters the fixing nip U. In that case, even when the curl occurs in the envelope S and the envelope S is in the open state between the front and back thereof, the flap Sa is first nipped in the fixing nip U, whereby the leading end of the envelope S on the non-address side is sandwiched between an address side sheet including the flap Sa and the guiding member 500, so that opening of the envelope S is suppressed. When the opening of the envelope S is suppressed, between the address side entering the fixing nip U early and the non-address side entering the fixing nip U later, i.e., between the front and back of the envelope S, timing of entrance of the envelope S into the fixing nip U does not readily deviate. As a result, the speed difference does not readily occur between the front and back of the envelope S and the slack does not occur in the envelope S, so that envelope crease due to the curl of the envelope S with the automatic reversed does not readily occur.

In FIG. 11, a display example of the case where as regards the "stacking method during double-side printing", the envelope S (for example, Western 3) with the flap Sa on the long side is stacked on the cassette 12, the manual feeding tray 11 and the stacking device 20 so that the flap Sa extends along the feeding direction is shown. As shown in FIG. 11, in the case where the envelope S is stacked on the cassette 12, the stacking method in which the address side is the upper surface side is displayed. In the case where the envelope S is stacked on the manual feeding tray 11 and the stacking device 20, the stacking method in which the non-address side is the upper surface side is displayed. Incidentally, in this example, the direction (orientation) of the flap Sa may be any direction when the flap Sa extends along the feeding direction.

In the case of this embodiment as shown in FIG. 11, even when the envelope S is stacked on any stacking portion, during the printing (toner image formation) on the second side, the envelope S reaches the fixing device 200 in a state in which the non-address side faces the guiding member 500 side. In this case, even if the curl occurs in the envelope S, when the leading end of the envelope S enters the fixing nip U, the flap Sa in a closed state is sandwiched between an non-address side sheet of the envelope S and the guiding member 500, so that the flap Sa is capable of being moved in a closing direction. That is, opening of the envelope S (specifically, the flap Sa) is suppressed. When the opening of the envelope S is suppressed, between the front and back of the envelope S, timing of entrance of the envelope S into the fixing nip U does not readily deviate. As a result, the speed difference does not readily occur between the front and back of the envelope S and the slack does not occur in the envelope S, so that envelope crease due to the curl of the envelope S with the automatic reversed does not readily occur.

As described above, in this embodiment, during double-side printing, the stacking method of the envelope S stacked on the manual feeding tray 11, the cassette 12, the stacking device 20 or the like is displayed at the display portion 410 depending on the kind of the envelope S. Accordingly, ease-of-use (usability) of the user is improved. Further, in the case where the envelope S is stacked in accordance with the display, during the printing on the second side, the envelope S reaches the fixing device 200 in a state in which the non-address side where the flap Sa is not formed faces the guiding member 500 side. As a result, as described above, the envelope crease due to the curl of the envelope S width the automatic reversal does not readily occur.

<Other Embodiments>

Incidentally, the "stacking method during double-side printing" in the case where the envelope S is stacked on the stacking portion so that the flap Sa extends along the direction crossing the feeding direction is not limited to the display example shown in FIG. 10 described above. For example, in the case where the envelope S is a rectangular envelope, the "stacking method during double-side printing" may also be a display example as shown in FIG. 12. As shown in FIG. 12, in the case where the envelope S is stacked on the cassette 12, a stacking method in which the flap side is the leading end side with respect to the feeding direction may also be displayed. In the case where the envelope S is stacked on the manual feeding tray 11 and the stacking device 20, a stacking method in which the flap side is the leading end side with respect to the feeding direction may also be displayed. As regards the stacking method of the envelope S shown in FIG. 12, as can be understood in comparison with the stacking method of the envelope S during one-side printing shown in FIG. 6, the non-flap side is positioned on a side opposite from the side shown in FIG. 6 with respect to the feeding direction. Incidentally, in this display example, display is made so that the non-address side is the upper surface side in the case where the envelope S is stacked on the cassette 12 and so that the address side is the upper surface side in the case where the envelope S is stacked on the manual feeding tray 11 and the stacking device 20, but display may also be made so that either one of the address side and the non-address side faces upward. It is only required that depending on whether the image is first printed on the address side or the non-address side as the first side, only a manner of display such that which one of the address side and the non-address side is the upper surface side is changed.

In the case of the display example shown in FIG. 12, even when the envelope S is stacked on any stacking portion, during the printing on the second side, the envelope S reaches the fixing device 200 in a state in which the non-flap side where the envelope S is closed in a bag shape is the leading end side with respect to the feeding direction, in other words, in a state in which the flap Sa is positioned on the trailing end side with respect to the feeding direction. In this case, even in a state in which the curl occurs in the envelope S with the automatic reversal and thus the envelope is in the open state between the front and back thereof, the envelope crease does not readily occur. This is because on the non-flap side of the envelope S, the front and back sheets are formed in the bag shape by being glued to each other, and therefore, even in a state in which the deviation between the front and back due to the curl occurs or in which the envelope S opens, the envelope S is less affected by such a state when the envelope S enters the fixing nip U. Further, even when the speed difference occurs between the front and back of the envelope S fed through the fixing nip U, the flap side where the envelope S is not formed in the bag shape finally passes through the fixing nip U, and therefore, even when the slack occurs in the envelope S, the envelope crease does not readily occur.

<Crease Suppressing Mode>

Further, the envelope crease due to the curl of the envelope S with the above-described automatic reversal does not occur in some instance depending on, for example, curvature of the bent path, paper quality and basis weight of the envelope S, and the like. In such a case, where the display of the "stacking method during one-side printing" and the display of the "stacking method during double-side printing" are made different from each other as described above, ease-of-use by the user is not good in some in stances. Therefore, in this embodiment, as shown in FIG. 5, the "crease suppressing mode key 415" is provided as the phantom operation element. The user is capable of causing the display portion 410 to display, during double-side printing, the same stacking method as the stacking method displayed during one-side printing by operating the "crease suppressing mode key 415" so as to be turned off. In this case, the controller 300 causes the selection information acquiring portion 301*d* to acquire selection information whether or not the stacking method of the envelope S should be displayed during double-side printing depending on the operation of the "crease suppressing mode key 415", and causes the memory 302 to store the acquired selection information (FIG. 3). Further, on the basis of the selection information, even during double-side printing, the controller 300 causes the display portion 410 to display the same stacking method as the stacking method displayed during one-side printing.

A display example of the stacking method of the envelope S in the case where the "crease suppressing mode" is set at "OFF" is shown in part (a) of FIG. 13, and a display example of the stacking method of the envelope S in the case where the "crease suppressing mode" is set at "ON" is shown in part (b) of FIG. 13. As shown in part (a) of FIG. 13, in the case where the "crease suppressing mode" is set at "OFF", even during double-side printing, the same stacking method as the stacking method (FIGS. 6 and 7) displayed during one-side printing is displayed at the display portion 410. On the other hand, as shown in part (b) of FIG. 13, in the case where the "crease suppressing mode" is set at "ON", during double-side printing, the above-described "stacking method during double-side printing" (FIGS. 10 and 11) is displayed at the display portion 410. Thus, the user can unify the stacking method of the envelope S between during one-side printing and during double-side printing by setting the "crease suppressing mode" at "OFF". As a result, for example, in the case where the envelope S which does not readily cause the envelope crease is used in printing such that the one-side printing and the double-side printing are carried out in mixture, the user is not required to perform a useless operation such that in accordance with the display at the display portion 410, the user takes the trouble to switch the stacking method of the envelope S between the one-side printing and the double-side printing.

<Vertical Feeding Type>

In the above-described embodiment, the image forming apparatus 100 of the lateral (horizontal) feeding type was described as an example, but the present invention is not limited thereto. The image forming apparatus to which the above-described controller 300 is applicable may also be an image forming apparatus of a vertical feeding type. An image forming apparatus 100A of the vertical feeding type is shown in FIG. 14. Incidentally, the image forming apparatus 100A of the vertical feeding type is largely different from the above-described image forming apparatus 100 of the lateral feeding type principally in the feeding mechanism and the constitution of the fixing device. Therefore, in this embodiment, constituent elements similar to those of the image forming apparatus of the lateral feeding type are represented by the same reference numerals or symbols (FIG. 1) and will be briefly described or omitted from description. Incidentally, in FIG. 14, as regards the image forming portions PY to PK, for convenience of illustration, the reference numerals or symbols are added only to the constituent elements of the image forming portion PK for black.

In the case of the vertical feeding type shown in FIG. 14, the envelope S in the cassette 12 (corresponding to the first stacking portion) is fed to the secondary transfer portion T2 so that the toner image is formed on the upper surface side thereof, and the envelope S on the manual feeding tray 11 or in the stacking device 20 (corresponding to the second stacking portion) is fed to the secondary transfer portion T2 so that the toner image is formed on the lower surface side. Further, in the case of the one-side printing, the envelope S on which first side the toner image is fixed is discharged by the discharging roller pair 15 onto the discharge tray 602 provided at the upper portion of the apparatus main assembly 100*a*. On the other hand, in the case of the double-side printing, the envelope S on which first side the toner image is fixed is fed to the discharging roller pair 15 which is normally rotated, and thereafter at timing when the trailing end passed through a flapper 18 is fed to the double-side feeding passage 600 by the discharging roller pair 15, which is reversely rotated, in a switch back manner. Thus, the leading and trailing ends of the envelope S are changed to each other by the reverse rotation of the discharging roller pair 15, and the envelope S is fed toward the registration roller pair 14 through the double-side feeding passage 600 and the feeding passage 601. In the case of the image forming apparatus 100A of the vertical feeding type, a portion constituted by the double-side feeding passage 600, the discharging roller pair 15 and the flapper 18 are an example of a feeding mechanism for automatically reversing the envelope S.

<Fixing Device>

Next, a fixing device 700 employed in the image forming apparatus 100A of the vertical feeding type will be described using FIG. 15. The fixing device 700 shown in FIG. 15 is a fixing device of a film heating type. The fixing device 700 includes a pressing roller 705 and a belt assembly 710 provided opposed to the pressing roller 705. The belt assembly 710 includes a fixing belt 701 which is formed in a cylindrical shape (endless shape) and which has flexibility, a stay 702, a pressing member 703 and a ceramic heater 704. The stay 702 is urged toward the pressing roller 705 with a predetermined urging force by an urging mechanism (not shown) such as a spring, for example. As a result, the fixing belt 701 and the pressing roller 705 are press-contacted to each other with a predetermined press-contact force. By the press-contact between the fixing belt 701 and the pressing roller 705, the fixing nip U for heat-fixing the toner image by passing the envelope S between the fixing belt 701 and the pressing roller 705 in a pressed state is formed. Further, in this embodiment, by the pressing member 703, the fixing belt 701 is pressed (urged) toward the pressing roller 705 from an inner peripheral surface thereof, so that the fixing nip U can be formed more reliably. At a portion where the pressing member 703 slides with the fixing belt 701, a ceramic heater 704 for heating the fixing belt 701 is provided. Incidentally, the fixing device 700 of the film-heating type described above is also applicable to the image forming apparatus 100 of the lateral feeding type (FIG. 1).

<Display Example of Envelope Stacking Method>

In the case of the image forming apparatus 100A of the vertical feeding type, a stacking method of the envelope S displayed at the display portion 410 with execution of the display control process (FIG. 8) by the controller 300 is shown in part (a) of FIG. 16 to FIG. 20. By taking, as an example, the case where an envelope S (for example, Square 2) with a flap Sa on a short side is stacked on the manual feeding tray 11, a display example of the "stacking method during one-side printing" was shown in part (a) of FIG. 16, and a display example of the "stacking method during double-side printing" was shown in part (b) of FIG. 16. In FIG. 17, as regards the "stacking method during double-side printing", a display example of the case where the envelope S with the flap Sa on the short side is stacked on the cassette 12, the manual feeding tray 11 and the stacking device 20 so that the flap Sa extends along the direction crossing the feeding direction was shown. In FIG. 18, as regards the "stacking method during double-side printing", a display example of the case where the envelope S with the flap Sa on the long side is stacked on the cassette 12, the manual feeding tray 11 and the stacking device 20 so that the flap Sa extends along the feeding direction was shown.

Incidentally, for reference purpose, in FIG. 19, as regards the "stacking method during one-side printing", a display example of the case where the envelope S with the flap Sa on the short side is stacked on the cassette 12, the manual feeding tray 11 and the stacking device 20 so that the flap Sa extends along the direction crossing the feeding direction was shown. In FIG. 20, as regards the "stacking method during one-side printing", a display example of the case where the envelope S with the flap Sa on the long side is stacked on the cassette 12, the manual feeding tray 11 and the stacking device 20 so that the flap Sa extends along the feeding direction was shown.

As can be understood from comparison as to during double-side printing between parts (a) of FIGS. 9 and 16, between parts (b) of FIGS. 9 and 16, between FIGS. 10 and 17 and between FIGS. 11 and 18 and from comparison as to during one-side printing between FIGS. 6 and 19 and between FIGS. 7 and 20, those display examples are merely different in the front and back of the envelope S. That is, the stacking method of the envelope S in the case of the image forming apparatus 100A of the vertical feeding type and the stacking method of the envelope S in the case of the image forming apparatus 100 of the lateral feeding type are merely different in the front and back of the envelope S. That is because as described above, the image forming apparatus 100A of the vertical feeding type and the image forming apparatus 100 of the lateral feeding type are different in the feeding manner of the envelope S from the cassette 12, the manual feeding tray 11 and the stacking device 20. Therefore, even in the case of the image forming apparatus 100 of the vertical feeding type, in accordance with the "stacking method during double-side printing", even when the envelope S is stacked on any magnetic portion, during printing on the second side, the envelope S reaches the fixing device 700 in a state in which the non-address side faces the guiding member 500 side. Accordingly, similarly as in the case of the image forming apparatus 100A of the lateral feeding type described above, the envelope crease due to the curl of the envelope S width the automatic reversal does not readily occur.

Further, also in the case of the image forming apparatus 100A of the vertical feeding type, the "stacking method during double-side printing" in the case where the envelope S is stacked on the stacking portion so that the flap Sa extends along the direction crossing the feeding direction is not limited to the display example shown in FIG. 17 described above. For example, in the case where the envelope S is a rectangular envelope, the "stacking method during double-side printing" may also be a display example as shown in FIG. 21. That is, as shown in FIG. 21, in the case where the envelope S is stacked on the stacking portion, a stacking method in which the flap side is the leading end side with respect to the feeding direction may also be displayed. As can be understood from comparison between FIGS. 12 and 21, also in this case, the feeding manners of the envelope S are different from each other, and therefore, the stacking method of the envelope S in the case of the image forming apparatus 100A of the vertical feeding type and the stacking method of the envelope S in the case of the lateral feeding type are only different in the front and back of the envelope S.

Therefore, even in the case of the image forming apparatus 100A of the vertical feeding type, in accordance with the "stacking method during double-side printing", even when the envelope S is stacked on any stacking portion, during the printing on the second side, the envelope S reaches the fixing device 700 in a state in which the non-flap side where the envelope S is closed in the bag shape is the leading end side with respect to the feeding direction. Accordingly, similarly as in the case of the image forming apparatus 100 of the lateral feeding type, the envelope crease due to the curl of the envelope S with the automatic reversal does not readily occur.

Incidentally, in the above-described embodiment, the image forming apparatus having the constitution in which the toner images of the respective colors are primary-transferred from the photosensitive drums 1Y to 1K for the colors onto the intermediary transfer belt 8, and then the composite toner images are collectively secondary-transferred onto the envelope S was described, but the present invention is not limited thereto. For example, an image forming apparatus of a direct transfer type in which the toner images are directly transferred from the photosensitive drums 1Y to 1K onto the envelope S may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-200391 filed on Oct. 24, 2018, which is hereby incorporated by reference herein in its entirety.

What is claimed is:

1. An image forming apparatus comprising:

an image forming portion that is (a) configured to form a toner image on an envelope including a flap and (b) configured to execute (i) an operation in a one side mode in which an image is formed on one side of the envelope and (ii) an operation in a double side mode in which images are formed on both sides of the envelope by automatically reversing the envelope;

a stacking portion configured to stack the envelope fed to said image forming portion;

a fixing portion configured to fix the toner image on the envelope, on which the toner image is formed by said image forming portion, at a nip portion where the envelope is nipped and fed;

a display portion configured to display information; and a controller configured to control said display portion to display a stacking method in which the envelope is stacked on said stacking portion in a state in which an orientation of the envelope is designated so that the envelope is entered into said nip portion with an orientation of the envelope of which the flap is positioned upstream in the feeding direction during toner image fixing on a second side in a case that the double side mode for the envelope of which the flap is open is selected.

2. An image forming apparatus according to claim 1, wherein said stack portion includes a manual feeding tray and a cassette, and wherein said controller is configured to cause said display portion to display (1) the stacking method in which the orientation of the envelope when the envelope is stacked on said manual feeding tray is designated and (2) the stacking method in which the orientation of the envelope when the envelope is stacked on said cassette is designated.

3. An image forming apparatus according to claim 1, wherein said controller causes said display portion to display a screen for selecting the kind of the envelope.

4. An image forming apparatus according to claim 1, wherein said controller causes said display portion to display a screen for selecting double side printing.

5. An image forming apparatus according to claim 1, further comprising an acquiring portion configured to acquire information corresponding to a kind of the envelope, wherein said controller is configured to control said display portion to display a stacking method in which the envelope is stacked on said stacking portion in a state in which an orientation of the envelope is designated on the basis of the information acquired by said acquiring portion is displayed at said display portion in a case that the one side mode is selected.

6. An image forming apparatus according to claim 1, wherein said controller is configured to control said display portion to display a stacking method in which the envelope is stacked on said stacking portion in a state in which an orientation of the envelope is designated so that the envelope is entered into said nip portion with an orientation of the envelope of which the flap is positioned upstream in the feeding direction in a case that the one side mode for the envelope of which the flap is open is selected.

7. An image forming apparatus comprising:

an image forming portion capable of forming a toner image on an envelope including a flap and capable of executing an operation in a one side mode in which an image is formed on one side of the envelope and an operation in a double side mode in which images are formed on both sides of the envelope by automatically reversing the envelope;

a stacking portion configured to stack the envelope fed to said image forming portion;

a fixing portion configured to fix the toner image on the envelope, on which the toner image is formed by said image forming portion, at a nip portion where the envelope is nipped and fed;

a guide portion configured to guide the envelope to said nip portion;

a display portion configured to display information; and a controller configured to control said display portion to display a stacking method in which the envelope is stacked on said stacking portion in a state in which an orientation of the envelope is designated so that during toner image fixing on a second side (a) an opposite side of the side where the flap is formed contacts said guide portion and (b) the envelope is entered into said nip portion with an orientation of the envelope of which the flap is positioned downstream in the feeding direction in a case that the double side mode for the envelope of which the flap is open is selected.

8. An image forming apparatus according to claim 7, wherein said stack portion includes a manual feeding tray and a cassette, and wherein said controller is configured to said display portion to display (1) the stacking method in which the orientation of the envelope when the envelope is stacked on said manual feeding tray is designated and (2) the stacking method in which the orientation of the envelope when the envelope is stacked on said cassette is designated.

9. An image forming apparatus according to claim 7, wherein said controller causes said display portion to display a screen for selecting the kind of the envelope.

10. An image forming apparatus according to claim 7, wherein said controller causes said display portion to display a screen for selecting double side printing.

11. An image forming apparatus according to claim 7, further comprising an acquiring portion configured to acquire information corresponding to a kind of the envelope.

12. An image forming apparatus according to claim 11, wherein said controller is configured to control said display portion to display a stacking method in which the envelope is stacked on said stacking portion in a state in which an orientation of the envelope is designated on the basis of the information acquired by said acquiring portion in a case that the one side mode is selected.

13. An image forming apparatus comprising:

an image forming portion capable of forming a toner image on an envelope including a flap and capable of executing an operation in a one side mode in which an image is formed on one side of the envelope and an operation in a double side mode in which images are formed on both sides of the envelope by automatically reversing the envelope;

a stacking portion configured to stack the envelope fed to said image forming portion;

a fixing portion configured to fix the toner image on the envelope, on which the toner image is formed by said image forming portion, at a nip portion where the envelope is nipped and fed;

a guide portion configured to guide the envelope to said nip portion;

a display portion configured to display information; and a controller configured to control said display portion to display a stacking method in which the envelope is stacked on said stacking portion in a state in which an orientation of the envelope is designated so that (a) a side where the flap is formed contacts said guide portion during toner image fixing on a first side and (b) an opposite side of the side where the flap is formed contacts said guide portion during toner image fixing on a second side in a case that the double side mode for the envelope of which the flap is closed and positioned along a feeding direction is selected.

14. An image forming apparatus according to claim 13, wherein said stack portion includes a manual feeding tray and a cassette, and wherein said controller is configured to cause said display portion to display the stacking method in which the orientation of the envelope when the envelope is stacked on said manual feeding tray is designated and the stacking method in which the orientation of the envelope when the envelope is stacked on said cassette is designated.

15. An image forming apparatus according to claim 13, wherein said controller causes said display portion to display a screen for selecting the kind of the envelope.

16. An image forming apparatus according to claim 13, wherein said controller causes said display portion to display a screen for selecting double side printing.

17. An image forming apparatus according to claim 13, further comprising an acquiring portion configured to acquire information corresponding to a kind of the envelope.

18. An image forming apparatus according to claim 17, wherein said controller is configured to control said display portion to display a stacking method in which the envelope is stacked on said stacking portion in a state in which an orientation of the envelope is designated on the basis of the information acquired by said acquiring portion in a case that the one side mode is selected.

* * * * *